US009637302B2

(12) United States Patent
Kuhar et al.

(10) Patent No.: US 9,637,302 B2
(45) Date of Patent: May 2, 2017

(54) ECONOMICALLY IMPROVED PLASTIC BOTTLE AND PACKAGE SYSTEM

(75) Inventors: Gene Kuhar, Lakeland, TN (US); Brian Smith, Collierville, TN (US); Rusty Shaver, Oakland, TN (US); Dan Gamber, Lakeland, TN (US); Douglas Dygert, Olive Branch, MS (US); Jeff Ullrich, Germantown, TN (US); Theodore Guss, Crystal Lake, IL (US)

(73) Assignee: RING CONTAINER TECHNOLOGIES, LLC, Oakland, TN (US)

( * ) Notice: Subject to any disclaimer, the term of this patent is extended or adjusted under 35 U.S.C. 154(b) by 287 days.

(21) Appl. No.: 13/613,681

(22) Filed: Sep. 13, 2012

(65) Prior Publication Data

US 2013/0068764 A1 Mar. 21, 2013

Related U.S. Application Data

(60) Provisional application No. 61/580,146, filed on Dec. 23, 2011, provisional application No. 61/533,869, filed on Sep. 13, 2011.

(51) Int. Cl.
*B65D 85/00* (2006.01)
*B65D 25/28* (2006.01)
(Continued)

(52) U.S. Cl.
CPC ..... *B65D 85/00* (2013.01); *B65D 1/18* (2013.01); *B65D 1/44* (2013.01); *B65D 21/0231* (2013.01);
(Continued)

(58) Field of Classification Search
CPC B65D 85/00; B65D 25/2858; B65D 25/2897; B65D 25/2894; B65D 77/0426; B65D 1/44; B65D 1/18
(Continued)

(56) References Cited

U.S. PATENT DOCUMENTS 3,158,284 A * 11/1964 Henchert ..... B65D 25/2858 16/445
3,285,454 A * 11/1966 Bailey ..... B65D 23/10 215/397
(Continued)

FOREIGN PATENT DOCUMENTS

DE 29722224 U1 2/1998
DE 10034552 A1 1/2001
(Continued)

OTHER PUBLICATIONS

International Search Report and Written Opinion for PCT/US12/55000 dated Jan. 2, 2013.
(Continued)

*Primary Examiner* — Fenn Mathew
*Assistant Examiner* — Elizabeth Volz
(74) *Attorney, Agent, or Firm* — Sorell, Lenna & Schmidt, LLP

(57) ABSTRACT

A packing that includes a bottle and/or a bottle and box combination wherein the container has a handle portion and the box has a bottom opening utilized as a grip portion. The handle is pivotally mounted to the top of the container. In addition, the box includes an opening to permit access to the handle and the neck of the container.

19 Claims, 35 Drawing Sheets

(51) Int. Cl.

| | |
|---|---|
| ***B65D 77/04*** | (2006.01) |
| ***B65D 1/18*** | (2006.01) |
| ***B65D 1/44*** | (2006.01) |
| ***B65D 21/02*** | (2006.01) |

(52) U.S. Cl.
CPC ..... *B65D 25/2858* (2013.01); *B65D 25/2894* (2013.01); *B65D 25/2897* (2013.01); *B65D 77/0426* (2013.01)

(58) Field of Classification Search
USPC ..... 220/4.26, 4.27, 23.83, 23.86, 23.87, 220/23.91, 495.03, 519, 752, 771, 772, 220/745, 913; 215/12.1, 396, 397, 398; 229/117.13, 117.24; 222/183, 465.1
See application file for complete search history.

(56) References Cited

U.S. PATENT DOCUMENTS

| | | | | | |
|---|---|---|---|---|---|
| 3,469,728 | A | * | 9/1969 | Bailey | B65D 23/108 215/397 |
| 3,638,835 | A | * | 2/1972 | Goodrich et al. | 222/107 |
| 3,990,683 | A | | 11/1976 | Ravreby | |
| 4,033,473 | A | * | 7/1977 | Raley | B65D 25/2858 220/604 |
| 4,215,782 | A | * | 8/1980 | Festag et al. | 206/525 |
| 4,524,883 | A | * | 6/1985 | Herring | B65D 77/065 206/509 |
| 4,805,793 | A | * | 2/1989 | Brandt | B65D 21/0231 206/509 |
| 4,987,639 | A | | 1/1991 | Baiuley et al. | |
| 5,462,169 | A | * | 10/1995 | Dygert | B65D 81/107 206/521 |
| 5,765,711 | A | * | 6/1998 | Johnson et al. | 220/62.2 |
| 6,045,036 | A | * | 4/2000 | Ring | B65D 77/0426 220/23.86 |
| D515,940 | S | | 2/2006 | Kratko | |
| 7,086,548 | B2 | * | 8/2006 | Bartlett | B65D 25/2894 215/398 |
| 2003/0102339 | A1 | * | 6/2003 | Walsh et al. | 222/567 |
| 2003/0132184 | A1 | * | 7/2003 | Dorn | B65D 1/18 215/10 |
| 2008/0073317 | A1 | * | 3/2008 | Dygert | B65D 1/20 215/397 |
| 2010/0200585 | A1 | * | 8/2010 | Dygert | B65D 1/20 220/23.83 |

FOREIGN PATENT DOCUMENTS

| | | | | |
|---|---|---|---|---|
| FR | 1.225.487 | A | 5/1959 | |
| FR | 1225487 | * | 5/1959 | B65D 77/04 |
| FR | 2823715 | A1 | 10/2002 | |
| GB | 2447334 | A | 9/2008 | |

OTHER PUBLICATIONS

Communication dated Apr. 20, 2015 from the European Patent Office in counterpart application No. 12832085.0.

* cited by examiner

ECONOMICALLY IMPROVED PLASTIC BOTTLE AND PACKAGE SYSTEM

CROSS-REFERENCE TO RELATED PATENT APPLICATION

This application claims the benefit of U.S. Provisional Patent Application No. 61/533,869 filed Sep. 13, 2011 and U.S. Provisional Patent Application No. 61/580,146 filed Dec. 23, 2011 in the U.S. Patent Trademark Office, the disclosures of which are incorporated herein in their entirety by reference.

BACKGROUND OF THE INVENTION

1. Field of the Invention

The present invention relates to an ergonomically designed bottle and package system.

2. Description of the Related Art

Multiple use container and composite packaging systems have been utilized in order to facilitate the storage and transport of a variety of materials. Often the container is used as the primary means for containing the material such that the material is sealed. These materials may include wet or dry goods and may come in a variety of dimensions. In some cases, the packaging system may further comprise an external box for housing the container. The box may be used to provide additional strength and/or protection and often provides for a packaging more suitable for stacking and transport. The external box also provides a surface that is suitable for advertising and describing the product contained therein.

Both the container and the packaging system may be used for the purpose of storing a material from the point of manufacture until it is delivered to its subsequent end use. Furthermore, the bottle in a package combination results in a configuration that is easily stackable for storage and transport in multiple unit stacking configurations.

One common use for these packages it for the distribution and use of oils, e.g., food service industry. Consequently, it is important that these systems enable a user to use and store the package safely and efficiently after the container is opened until the product has been fully consumed.

However, the conventional containers do not always provide all of these benefits in an economically efficient manner. That is, the use of handles and thick walled containers require external packaging that is large and of a relatively high weight. Furthermore, most composite packaging systems require that the container be withdrawn from the box in order to access the contents container therein. This is especially problematic when the spout must be accessed in order to pour contents from the container. Thus, the container, during end use, loses the benefits associated with the box part of the system, i.e. stackability.

Therefore, there is a need for an improved container that provides for better ergonomic handling during both pouring and carrying, while having a minimal size and weight.

SUMMARY OF THE INVENTION

Accordingly, an aspect of the present invention is to provide a packaging comprising a container in a box. The container comprising a top, a bottom sides extending from the top to the bottom and comprising a front side and a back side. The container also includes a neck extending from a top of the container for inserting and removing contents from the container and a handle pivotally attached to the container. The box comprises the box comprising a top cover, a bottom cover and side portions extending from the top cover to the bottom cover that include a front side and a back side. The box also includes an opening on the top cover that expose the neck for pouring the contents of the container and that provide space for folding the handle between a first position where the handle contacts the top of the container and a second position where the handle extends upward from the top of the container. The opening in the bottom cover exposes the bottom of the container.

According to another aspect, a top of the neck is disposed below a level of the top cover.

According to another aspect, a top of the neck extends above a top level of the top cover.

According to another aspect, the bottom of the container includes a recess directly below the neck that is sized to fit and receive a neck of the same size. The opening in the bottom cover is sized to expose the recess to enable insertion of a neck of an adjacent container.

According to another aspect, the average wall thickness of the sides is within the range 0.010 to 0.014 inches.

According to another aspect, the top of the container comprises a recess portion configured to receive the handle when the handle is in the first position such that the handle does not protrude above the top of the container. The packaging may also include a second recess portion positioned adjacent the neck; and a tube extending from a side of the neck over the second recess to communicate with a portion of the top of the container that is disposed between the second recess and the recess portion.

According to another aspect, the container includes protrusions disposed on the recess portion configured to secure the handle before it is pivotally attached to the container.

According to another aspect, the handle is pivotally connected to a flash portion extending from the top of the container.

According to another aspect, the handle is integrally molded with the container.

According to another aspect, a grip recess portion is included on the top of the bottle disposed at a rear portion of the top.

According to another aspect a packaging is provided comprising a container in a box. The container comprising a top, a bottom sides extending from the top to the bottom and comprising a front side and a back side. The container also includes a neck extending from a top of the container for inserting and removing contents from the container and a grip recess formed in the top of the container. The box comprises the box comprising a top cover, a bottom cover and side portions extending from the top cover to the bottom cover that include a front side and a back side. The box also includes an opening on the top cover that expose the neck for pouring the contents of the container and that provide space accessing the grip recess. The opening in the bottom cover exposes the bottom of the container.

According to another aspect, a top of the neck extends above a top level of the top cover and the bottom of the container includes a recess directly below the neck that is sized to fit and receive a neck of the same size. The opening in the bottom cover is sized to expose the recess to enable insertion of a neck of an adjacent container.

According to another aspect, the average wall thickness of the sides is within the range 0.010 to 0.014 inches.

According to another aspect the packaging further comprising a speaker portion disposed on at least one of the sides of the container to absorb pressure to thereby prevent a failure of the container.

According to another aspect, the packing efficiency is greater than 80 percent.

BRIEF DESCRIPTION OF THE DRAWINGS

The above and other features and aspects of the present invention will become more apparent by describing in detail non-limiting, exemplary embodiments thereof with reference to the attached drawings in which:

FIG. 23 is a front view of a plastic container in accord with a fourth embodiment of the present invention.

DETAILED DESCRIPTION OF THE INVENTION

Figure 1:
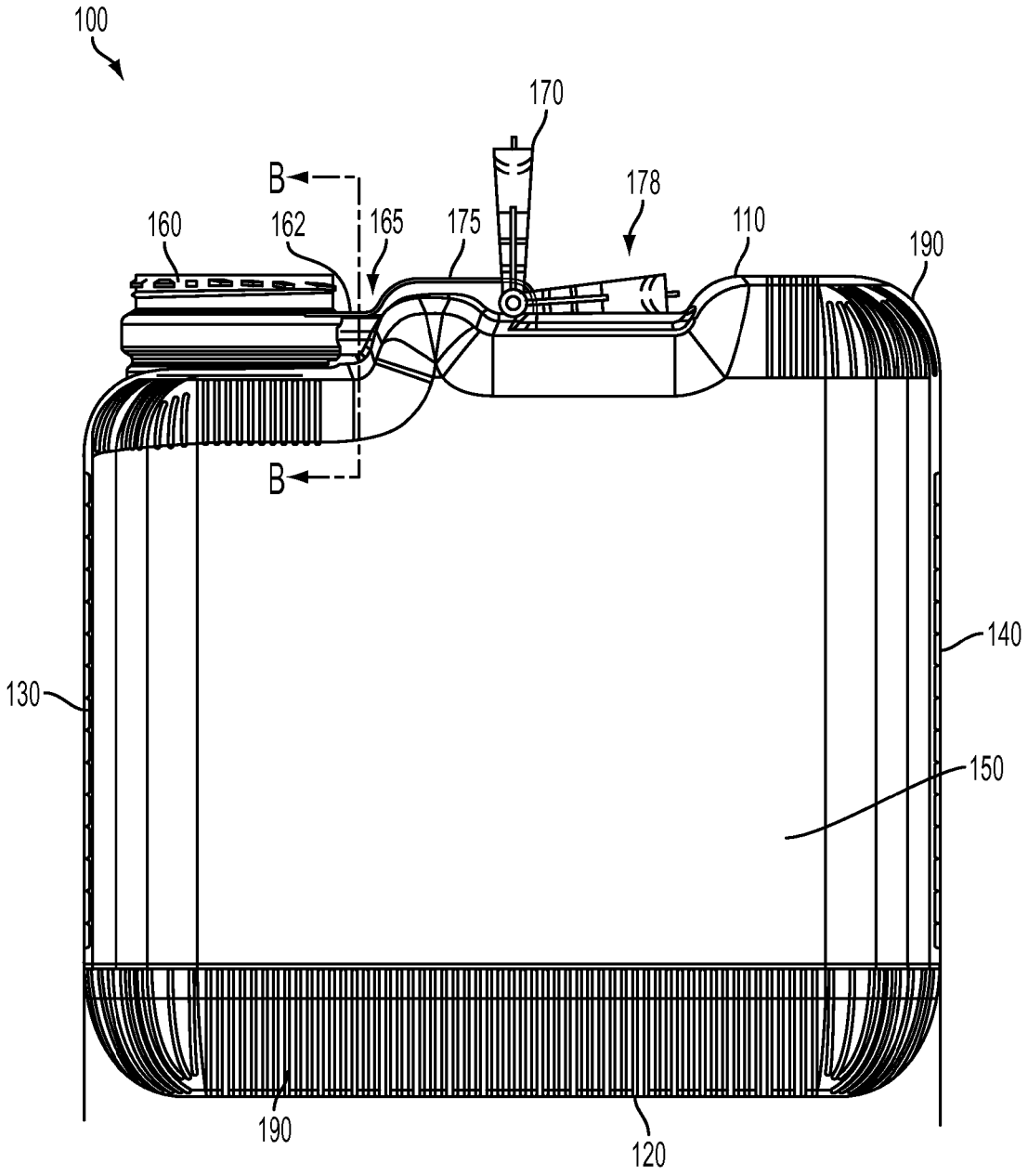
FIG. 1 is a side view of a plastic container in accord with a first embodiment of the present invention.
Figure 2:
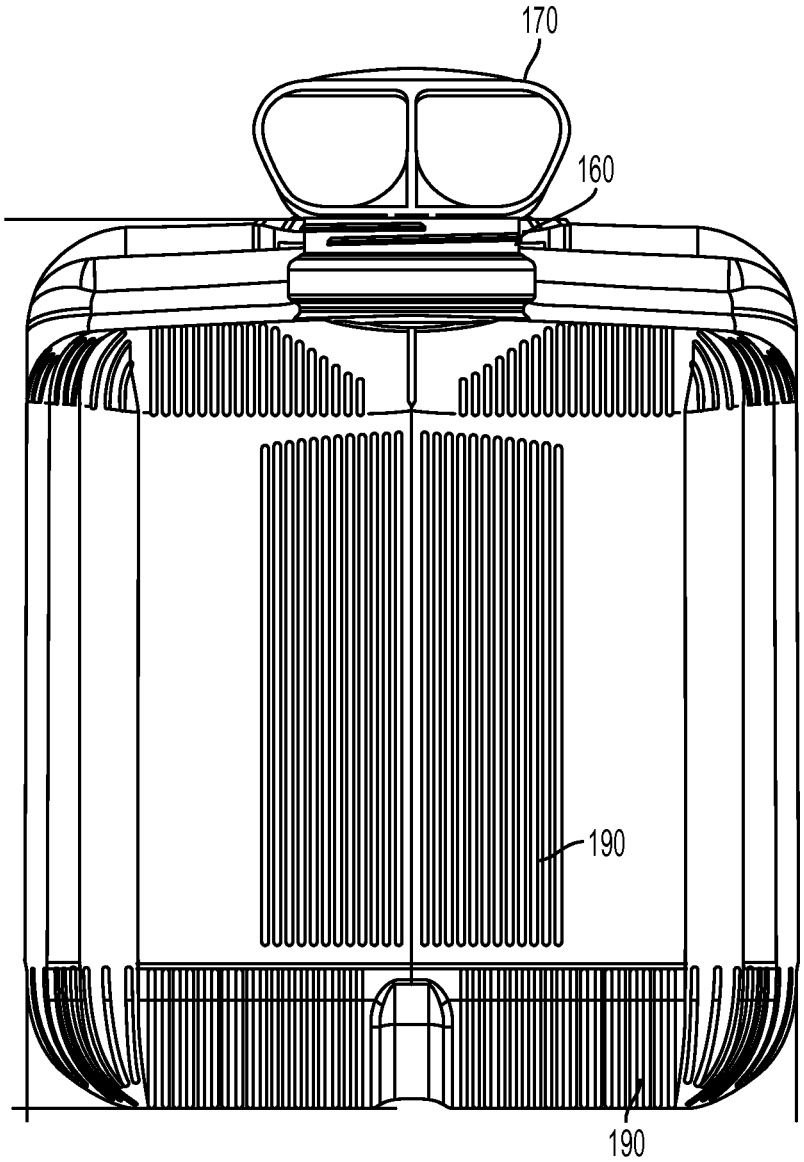
FIG. 2 is a front view of the plastic container in accord with the first embodiment.

The container and packing system according to the present invention according to the non-limiting, exemplary embodiments of the present invention will now be described more fully with reference to the accompanying drawings.

FIGS. 1-8 show features of the plastic bottle/corrugated carton container in accord with the first embodiment of the present application. FIGS. 1-4 show multiple views of a plastic container 100 having a top 110, a bottom 120, a front 130, a back 140 and two sides 150. The plastic container 100 is sealable by placing a closure on a threaded portion of the neck (spout) 160. The plastic container may be made of various materials. However, in the present embodiment, to minimize weight, the bottle is made of high density polyethylene (HPDE) having a thickness of 0.010-0.014 inches. The volume of the plastic container 100 of this embodiment is about 584 ounces.

Figure 31:
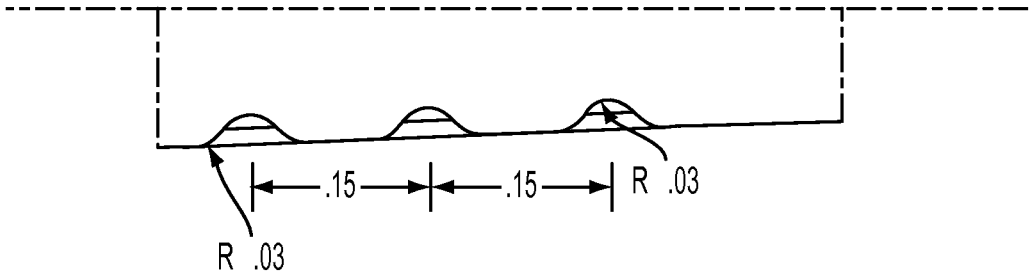
FIG. 31 is a cross-sectional view of the ribs used in each embodiment of the application.

Additionally, to add some strength and rigidity to the plastic container 100, ribs 190 are added to various portions where needed. In this embodiment, the ribs 190 are added to the corners bridging the top 110 to the side portions and the corners bridging the bottom 120 to the side portions. A cross-sectional structure of these ribs is shown in FIG. 31. The ribs extend internally and have a radius of 0.03 inches, but this radius may range from 0.020 to 0.040 inches. Each rib is spaced 0.15 inches from an adjacent rib, but this spacing may range from 0.130 to 0.170 inches. The ribs are dimensioned add strength while not overly thinning the wall structure when the plastic container is molded.

The ribs 190 may be added to the front 130 of the plastic container 100 to provide additional strength to those portions below the neck 160 to prevent the neck 160 from sagging. Also, the portions of the back 140 and sides 150 may also be fitted with ribs 190.

Ergonomically, the plastic container includes a handle 170 that is pivotally attached to the top 110 of the plastic container 100. While not being limited to any particular location, in this embodiment, the handle 170 is pivotally connected to a portion of the top 110 substantially above the center of gravity of the filled container. This prevents a full container from tilting when lifted by the handle and thereby prevents accidental spilling of the contents when grasped by the handle 170. Consequently, the positioning of the handle 170, while not necessarily being confined to being directly above the center of gravity, should be placed such that the tilting is limited to an amount that prevents accidental spilling. In addition, the handle 170 is configured to pivot about an axis that extends perpendicular to the front/back direction of the plastic container 100.

While conventional plastic containers utilize a handle that is integrally molded with the plastic container, when the container walls are designed to have a finished thickness of 0.010-0.014 inches, such a complex shape may induce material thickness variations falling well below this thickness range, and thus, may result in weak or thin areas highly susceptible to failure. Consequently, in this embodiment, the handle 170 is pre-molded separately from the plastic container 100 and then added by pressing a pin through a flash portion 175 that is integrally formed during the molding of the plastic bottle 100.

Figure 5:
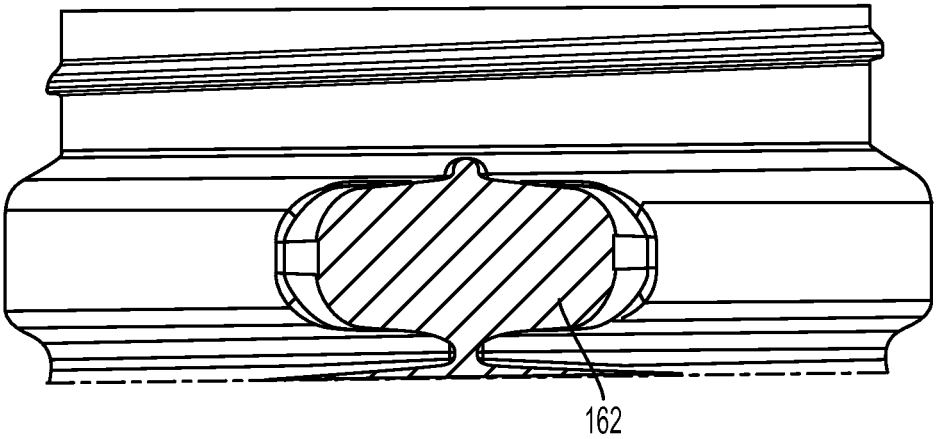
FIG. 5 is a cross-sectional view B-B of FIG. 1.

The top 110 of the plastic container 100 also includes an anti-glug recess 165 and a handle recess 178, which run horizontally from side to side across the container. These recesses define upper ridges that provide structurally rigidity at the top 110 of the plastic container 100. Further, the anti-glug recess 165 provides separation from the upper volume of the container and the neck 160. These portions are connected using a tube 162 that permits air flow into the top of the plastic container 100 during pouring to prevent glugging. FIG. 5 shows a cross-sectional view of the tube 162 extending from the neck 160 of the container.

The handle recess 178, on the other hand, in addition to adding some structural rigidity, also provides a parking space for the handle so that the plastic container 100 can be stacked when placed in a corrugated carton.

Figure 3:
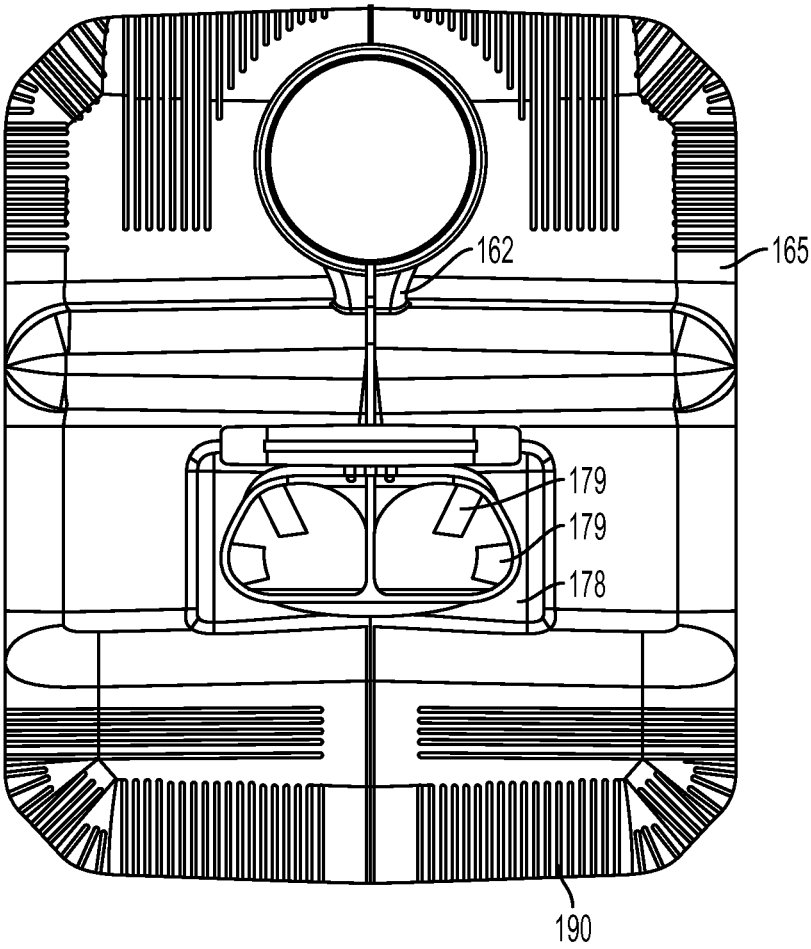
FIG. 3 is a top view of the plastic container of the first embodiment.
Figure 4:
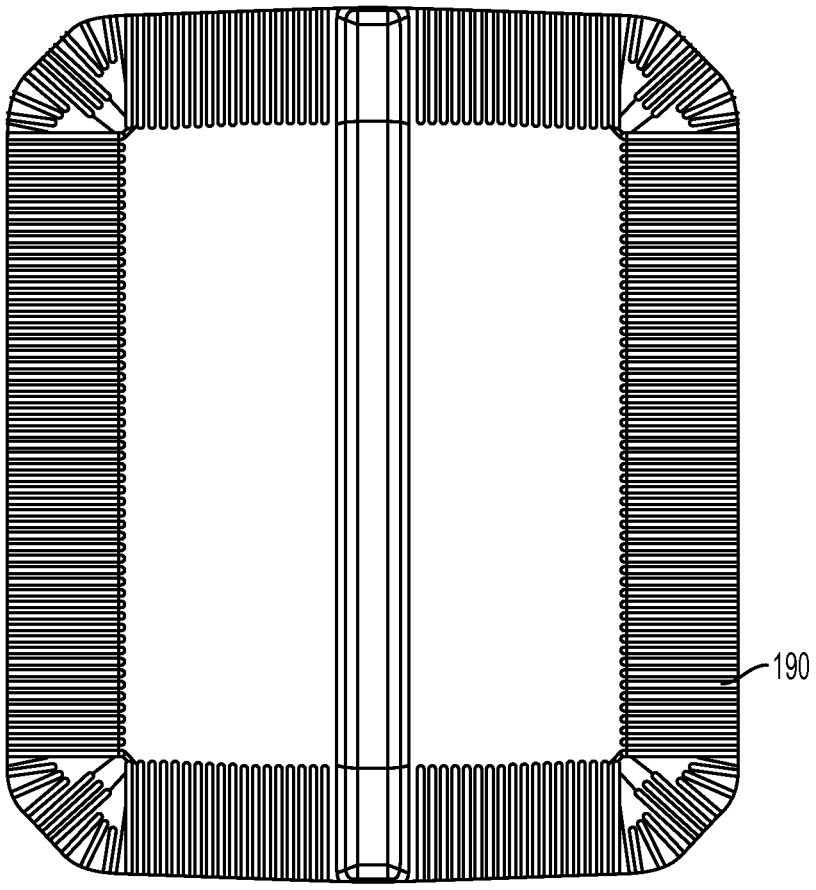
FIG. 4 is a bottom view of the plastic container of the first embodiment.
Figure 8:
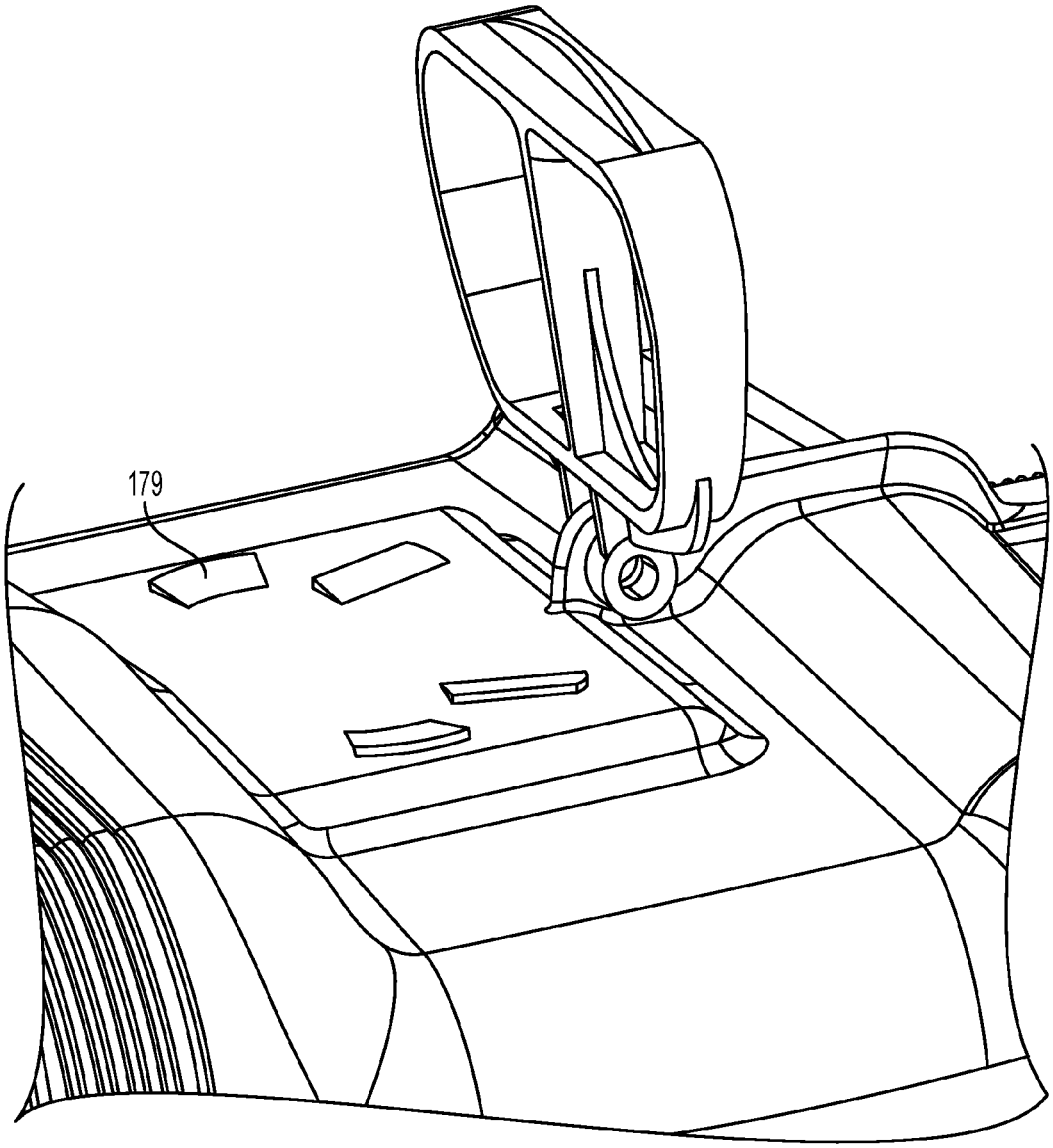
FIG. 8 is a perspective view showing the D-handle in accord with the first embodiment.
Figure 9:
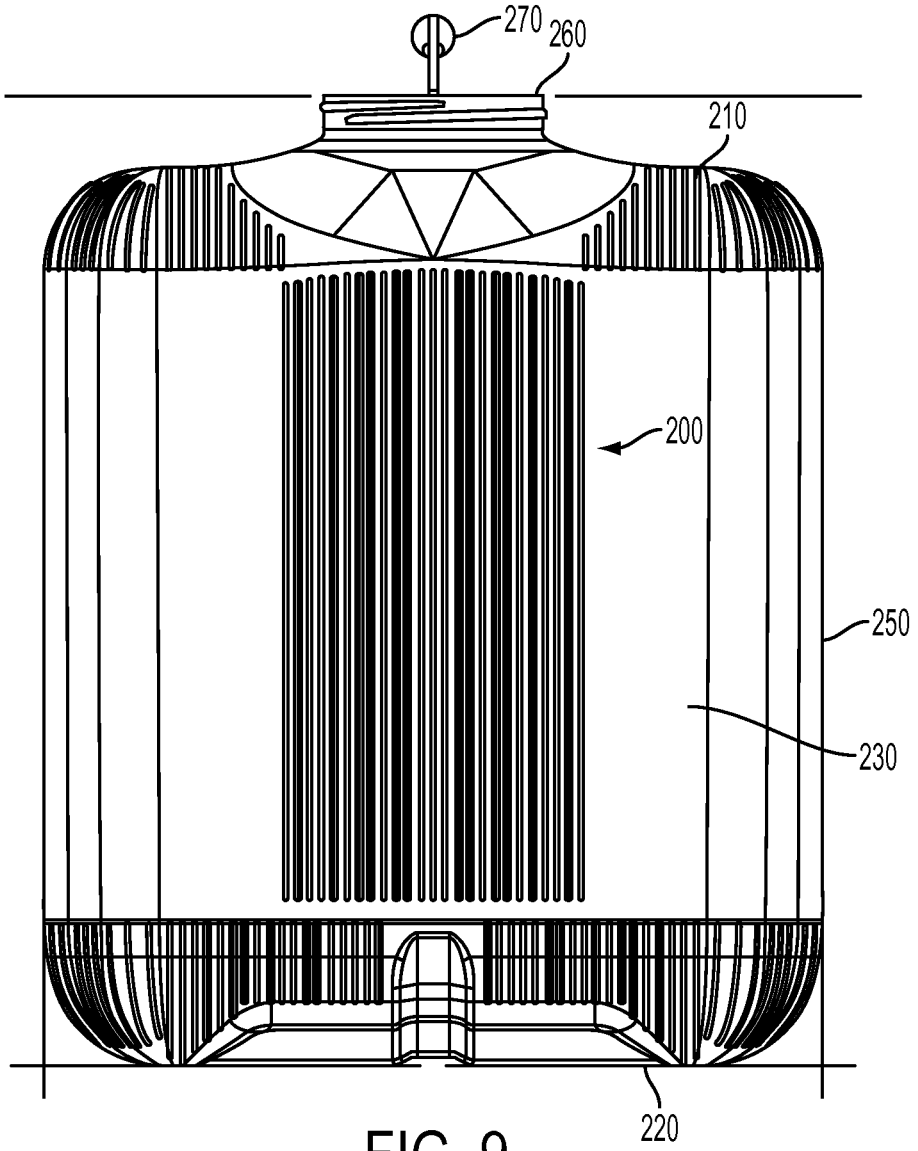
FIG. 9 is a front view of a plastic container in accord with a second embodiment of the present invention.
Figure 10:
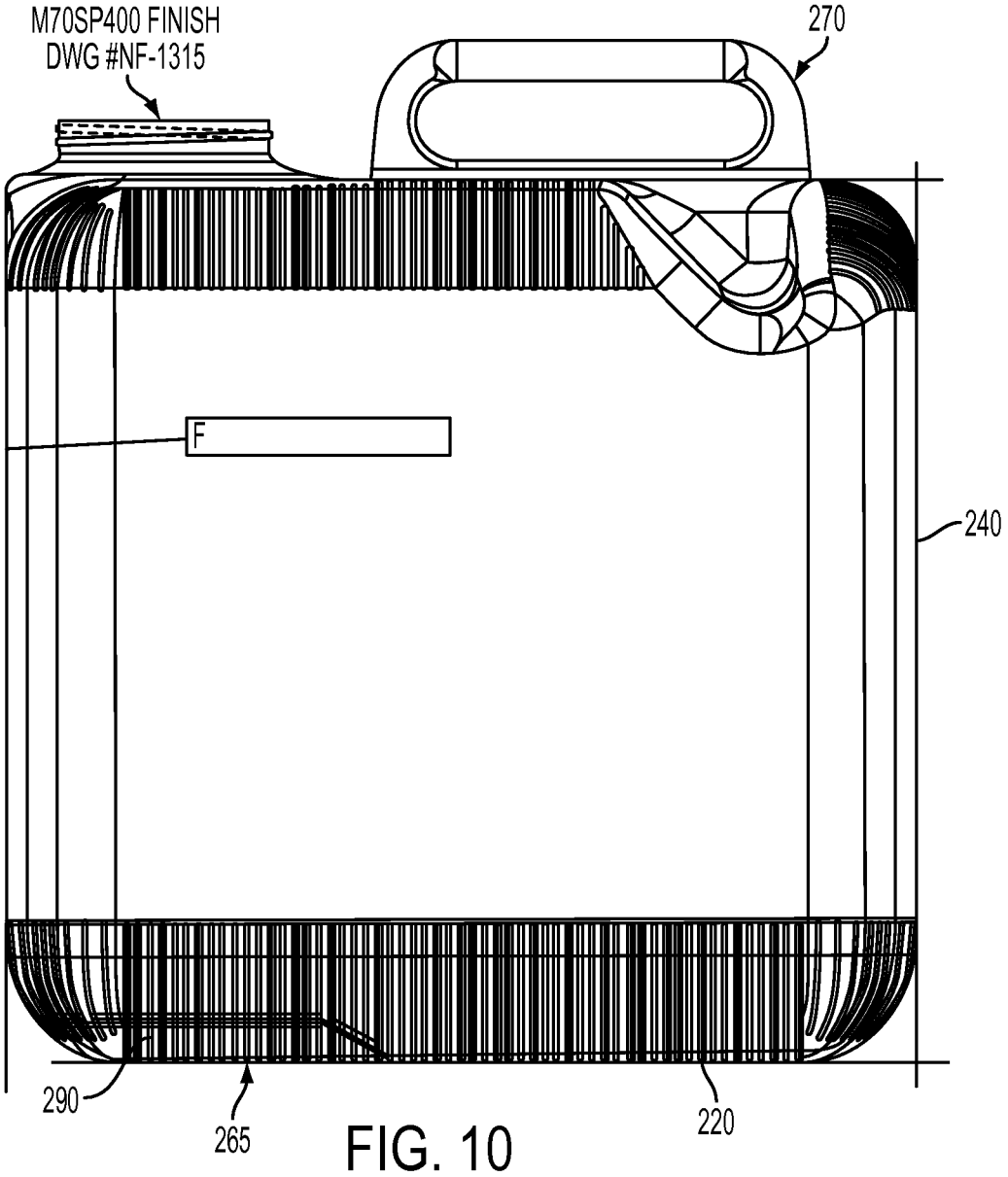
FIG. 10 is a side view of the plastic container in accord with the second embodiment.
Figure 11:
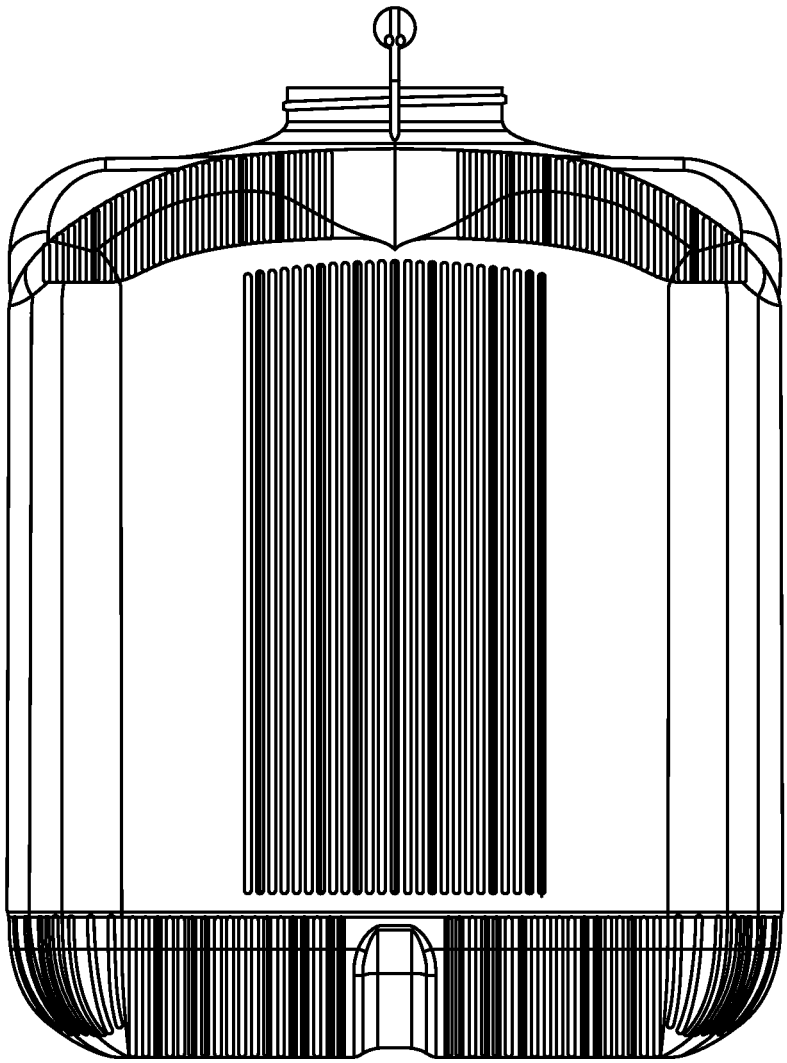
FIG. 11 is a rear view of the plastic container of the second embodiment.
Figure 12:
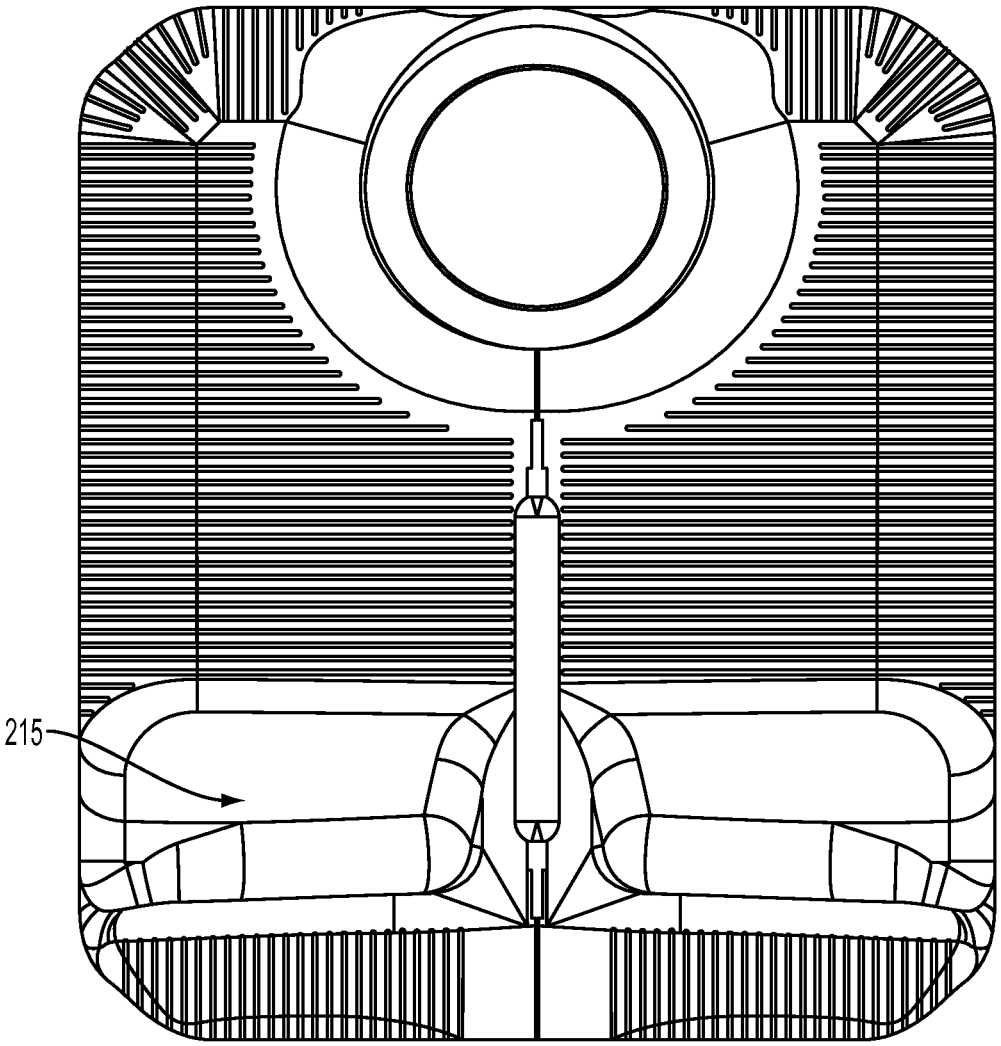
FIG. 12 is a top view of the plastic container of the second embodiment.
Figure 13:
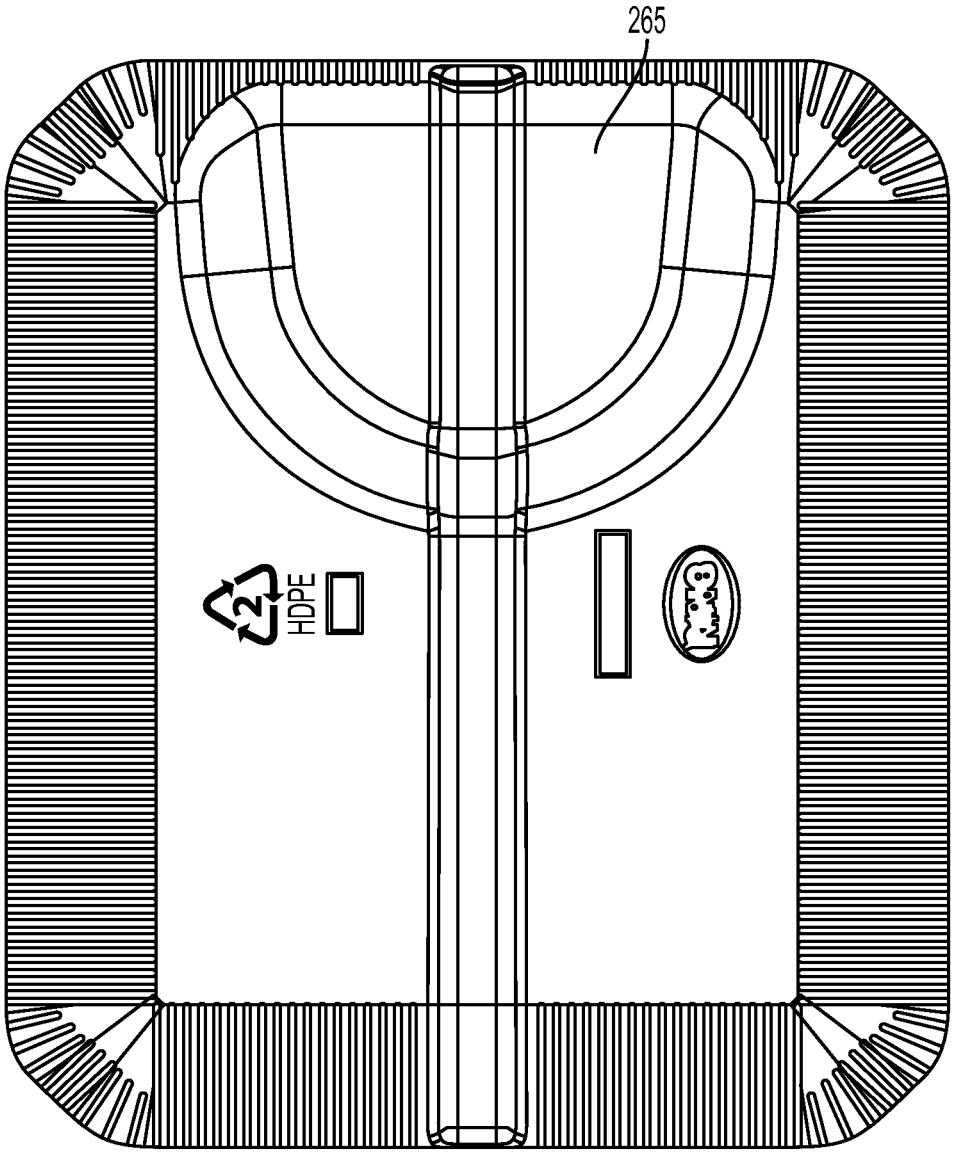
FIG. 13 is a bottom view of the plastic container of the second embodiment.

In addition, as shown in FIG. 3, the handle recess 178 includes detents 179 that are raised portions that prevent the handle 170 from shifting locations after it is placed on the plastic bottle 100, but before the handle 170 is attached to the flash portion 175 using a pin. As shown in FIG. 8, the detents may be formed in an inclined structure having a raised edge that is configured to engage with the handle 170. When making the plastic container, the detents 179 are molded with the container. Thereafter, the handle 170 is placed on the plastic container and held in position by the detents. A pin is then pressed through holes in the handle 170 and a flash portion of the plastic container 100 to pivotally secure the handle 170 to the plastic container 100.

Figure 6:
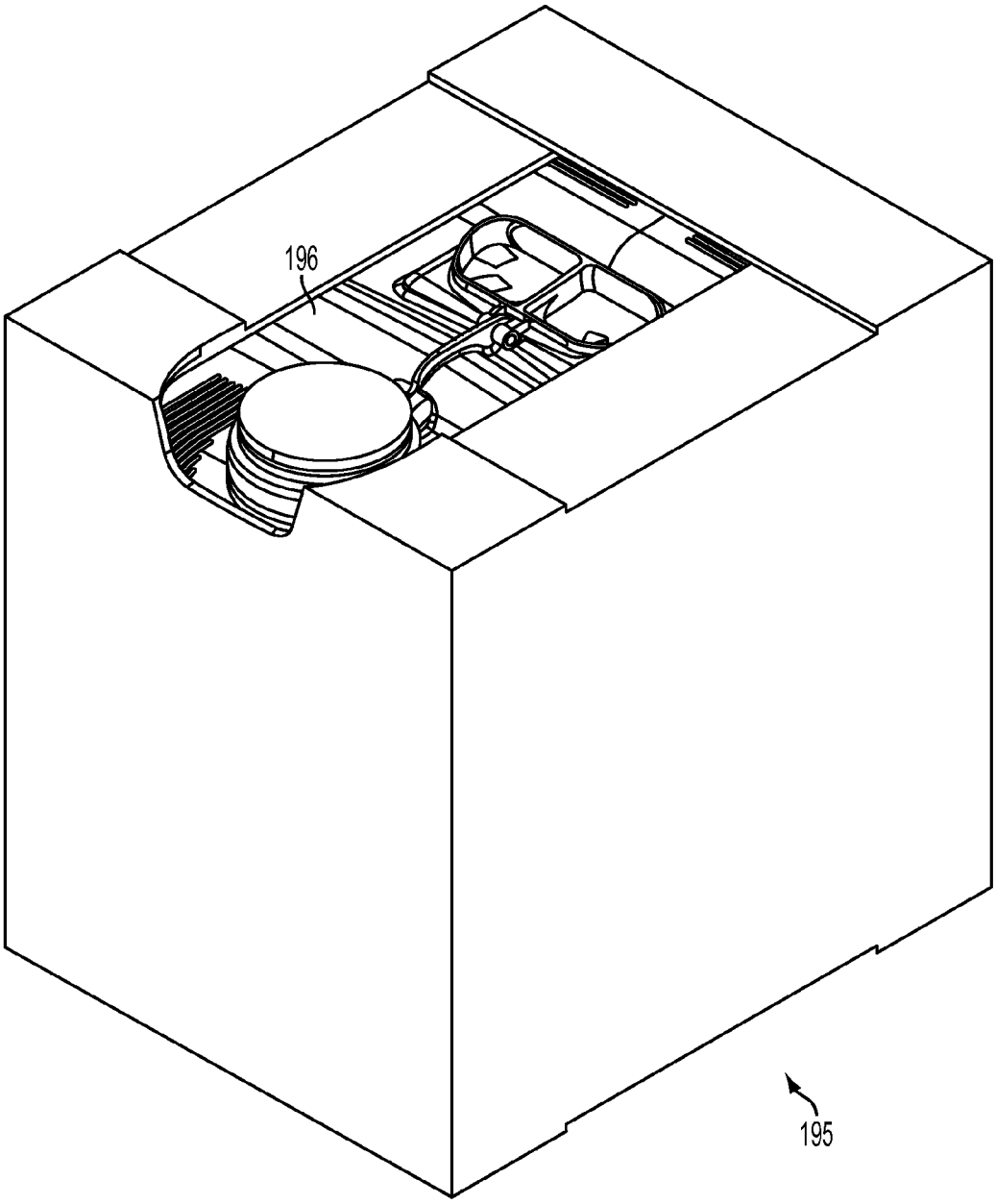
FIG. 6 is a top perspective view of the plastic container of FIG. 1 contained within a corrugated container in accord with the first embodiment.
Figure 7:
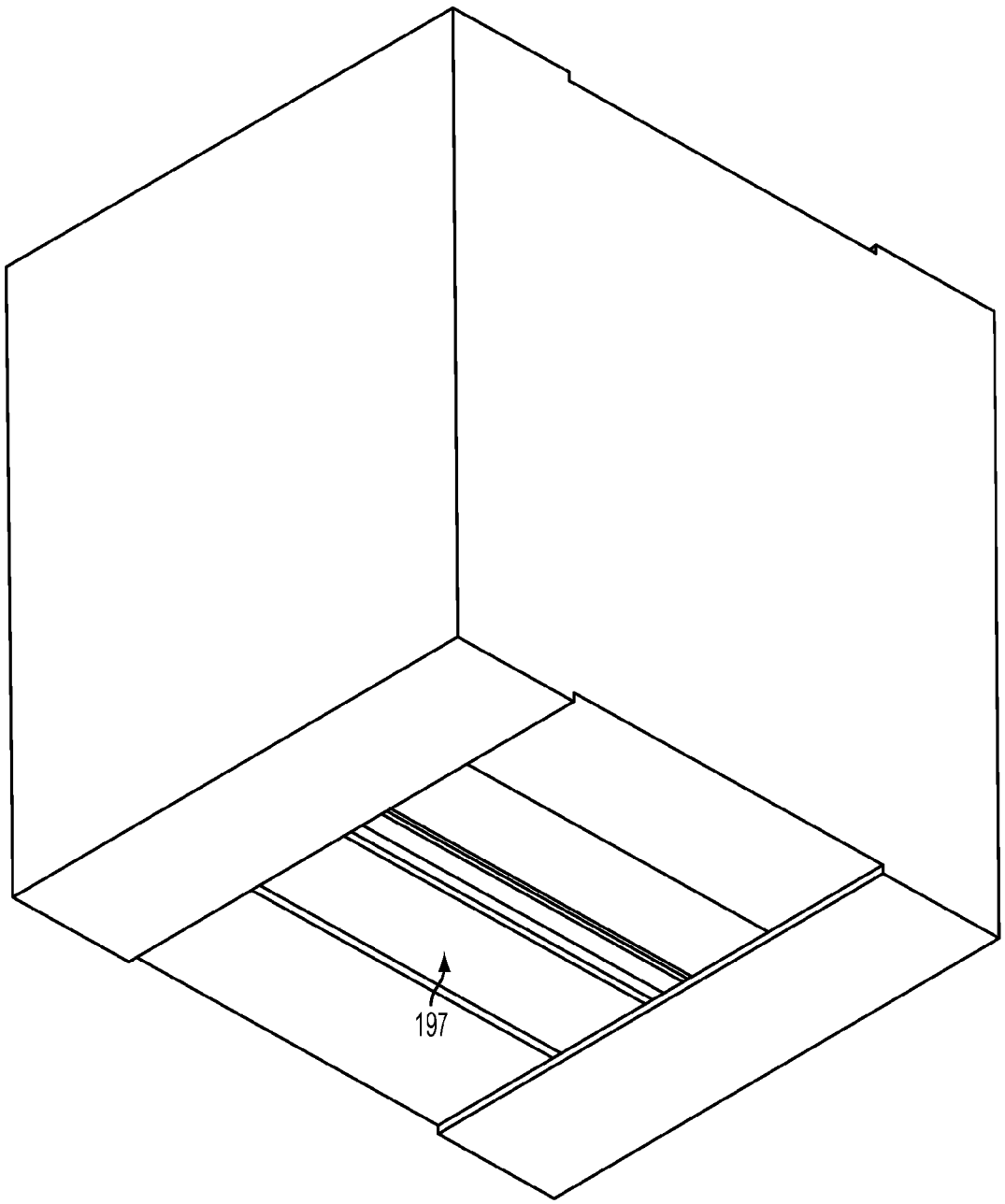
FIG. 7 is a bottom perspective view of the plastic container of FIG. 1 contained within a corrugated container in accord with the first embodiment.

Because of the lightweight nature of this plastic container 100, it is coupled with a corrugated carton as shown in FIGS. 6 and 7 to provide additional structural support. When used in this configuration, the packaging system (bottle and carton) is stackable. Otherwise, the plastic container 10 of this size when filled with oil, for example, may collapse on itself.

Using a corrugated carton 195 to house the plastic container 100 creates a packaging system that permits the use of a thin walled container 100. In addition, the corrugated carton 195 is fitted with a top opening 196 that permits access to the neck 160 and handle 170 for pouring. As shown in FIG. 6, the top opening 196 extends through at least the height of the neck 160 on the front 130 of the plastic container to a position behind the handle 170. This enables a user to empty the contents of the plastic container 100 without first removing it from the corrugated carton. The user can access the handle to rotate it upward. In addition, the extension of the opening along the front adjacent the neck, enables a user to pour contents without impacting the front of the corrugated carton 195. Accordingly, even after the packaging has been accessed to consume the contents, the packaging system remains intact. Thus, the stackability of the packaging system can be maintained until all of the product is consumed. In view of this, the corrugated carton also serves to absorb any liquid spillage that may ordinarily remain on the plastic container 100 after pouring out a portion of the contents.

In addition, as shown in FIG. 7, the bottom of the corrugated carton 195 also has an opening 197. This bottom opening is defined by the bottom flaps of the carton and may be gripped by a user when pouring the contents of the plastic container 100.

As shown in these figures, by providing the container with a foldable handle and having a top surface parallel with the top of the neck 160, the packing efficiency of the packaging system, i.e., the ratio of the internal volume of the corrugated carton to the internal volume of the plastic container 100, is maximized over the related art.

A second embodiment of the present invention is illustrated in FIGS. 9-17, which show multiple views of a plastic container 200 having a top 210, a bottom 220, a front 230, a back 240 and two sides 250. The plastic container 200 is sealable by placing a closure on a threaded portion of the neck (spout) 260. The plastic container may be made of various materials. However, in the present embodiment, to minimize weight, the bottle is made of high density polyethylene (HPDE) having a thickness of 0.010-0.014 inches. The volume of the plastic container 200 of this embodiment is about 584 ounces.

Additionally, to add some strength and rigidity to the plastic container 200, ribs 290 are added to various portions in the same manner as described in the first embodiment.

Ergonomically, the plastic container includes a handle 270 that is pivotally attached to the top 210 of the plastic container 200. While not being limited to any particular location, in this embodiment, the handle 270 is pivotally connected to a portion of the top 210 and is integrally formed using the flash generated when molding the plastic container 200. In contrast to the first embodiment, this handle pivots about an axis parallel to the front/back direction of the plastic container 200. The handle 270 also has a portion that is configured to extend to a portion of the top 210 that is vertically above the center of gravity of the filled container.

It is noted that the handle 170 of the first embodiment and the handle 270 are configured to pivot in different directions. However, the handle 170 may be configured to pivot in the same manner as the handle 270 and vice versa. While conventional plastic containers utilize a handle that is integrally molded with the plastic container, they typically include some amount of hollow volume and also require a thicker walled structure. However, when the container walls are designed to have a finished thickness of 0.010-0.014 inches, such a complex shape may induce material thickness variations falling well below this thickness range, and thus, may result in weak or thin areas highly susceptible to failure. Consequently, in this embodiment, the handle 270 is solid and molded using the excess flash present at the top of the plastic container 200.

Figure 16:
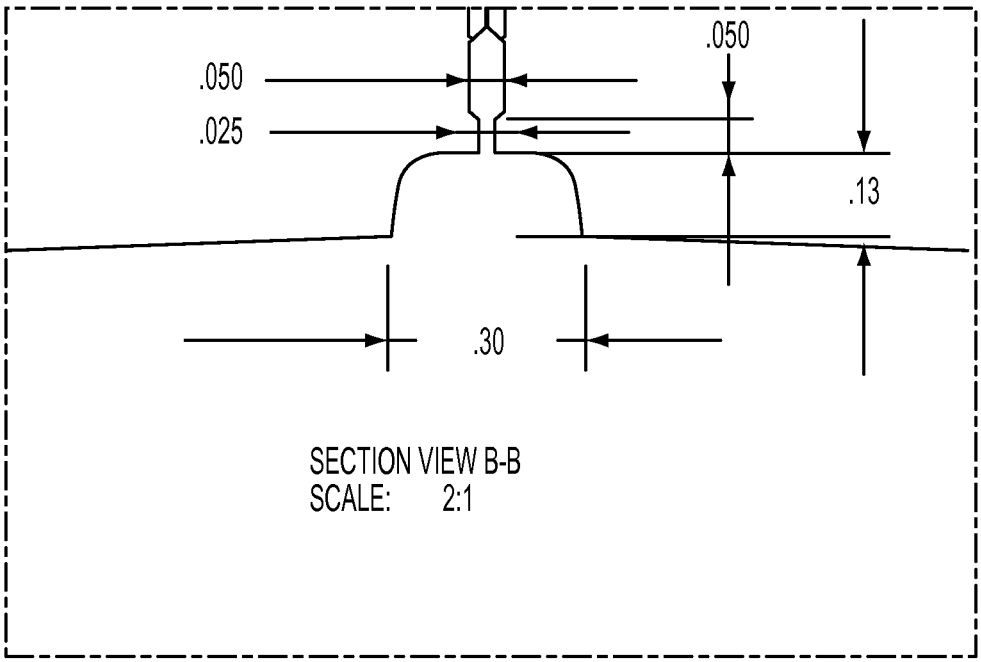
FIG. 16 is a cross-sectional view of the handle of the plastic container in accord with the second embodiment.

In addition, this handle 270 is formed of a relative low profile so that the size of the packing system as describe can be minimized. As shown in FIG. 16, the handle 270 is formed using the flash at the top of the plastic container 200. The upper portion of the handle 270 is joined to the plastic container 200 by lower portion comprising a thin section of material having a thickness of 0.025 inches, but this portion may have a thickness ranging from 0.015 to 0.040 inches. The upper portion is made thicker than the lower portion so that the handle 270 pivots about a location adjacent the top 210 of the plastic container 200. The thickness of the upper portion is about 0.050, but may range from 0.030 to 0.070 inches.

Figure 17:
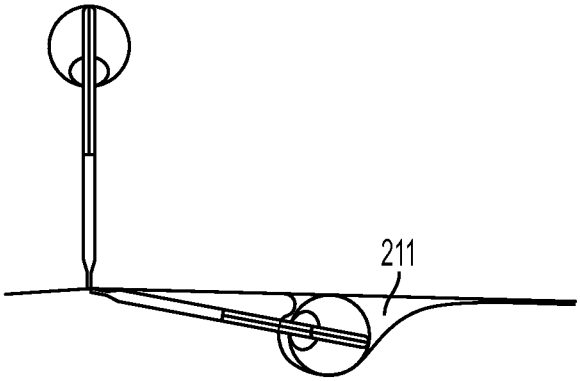
FIG. 17 is a view showing a parking area for the handle of the second embodiment.
Figure 18:
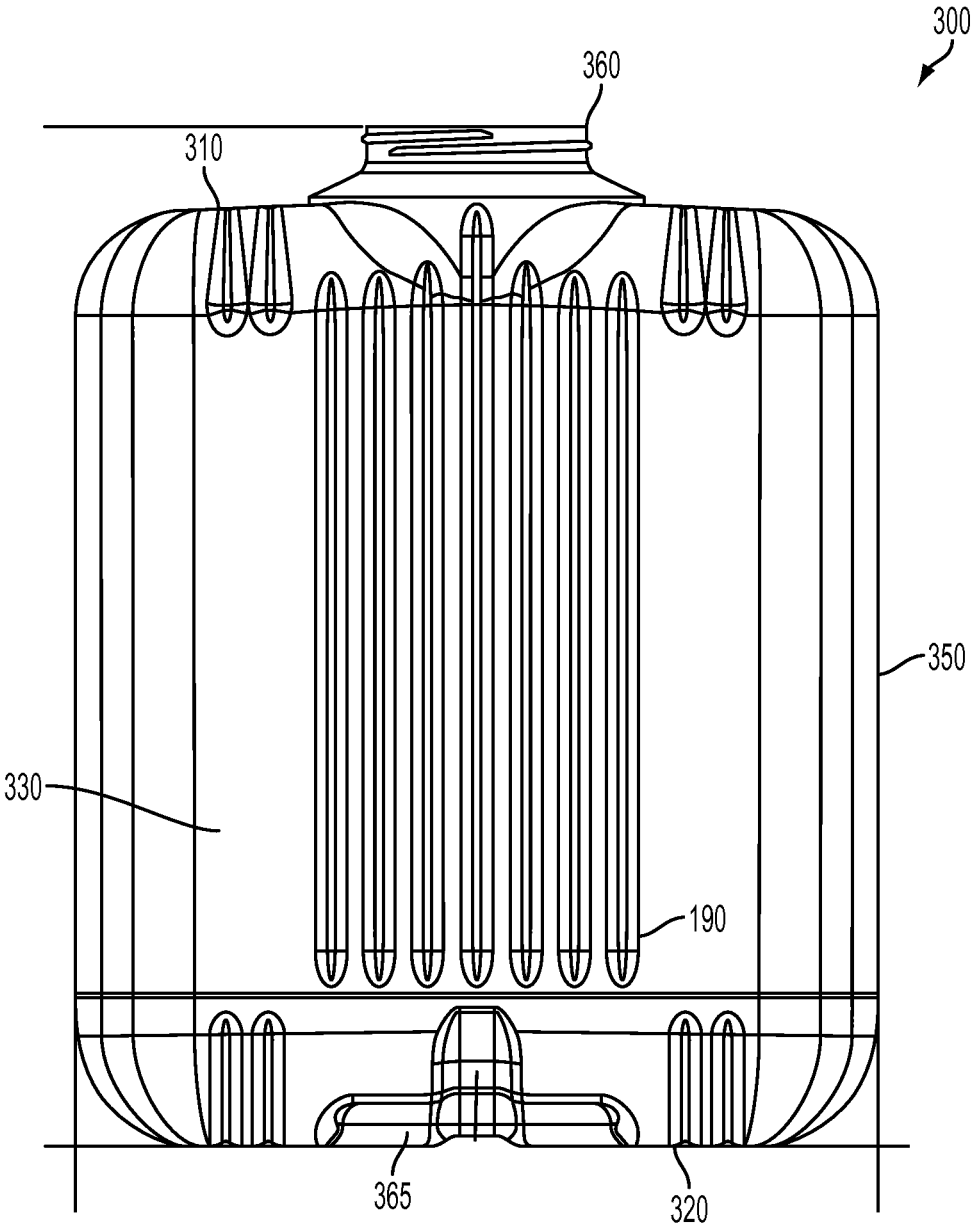
FIG. 18 is a front view of a plastic container in accord with a third embodiment of the present invention.
Figure 19:
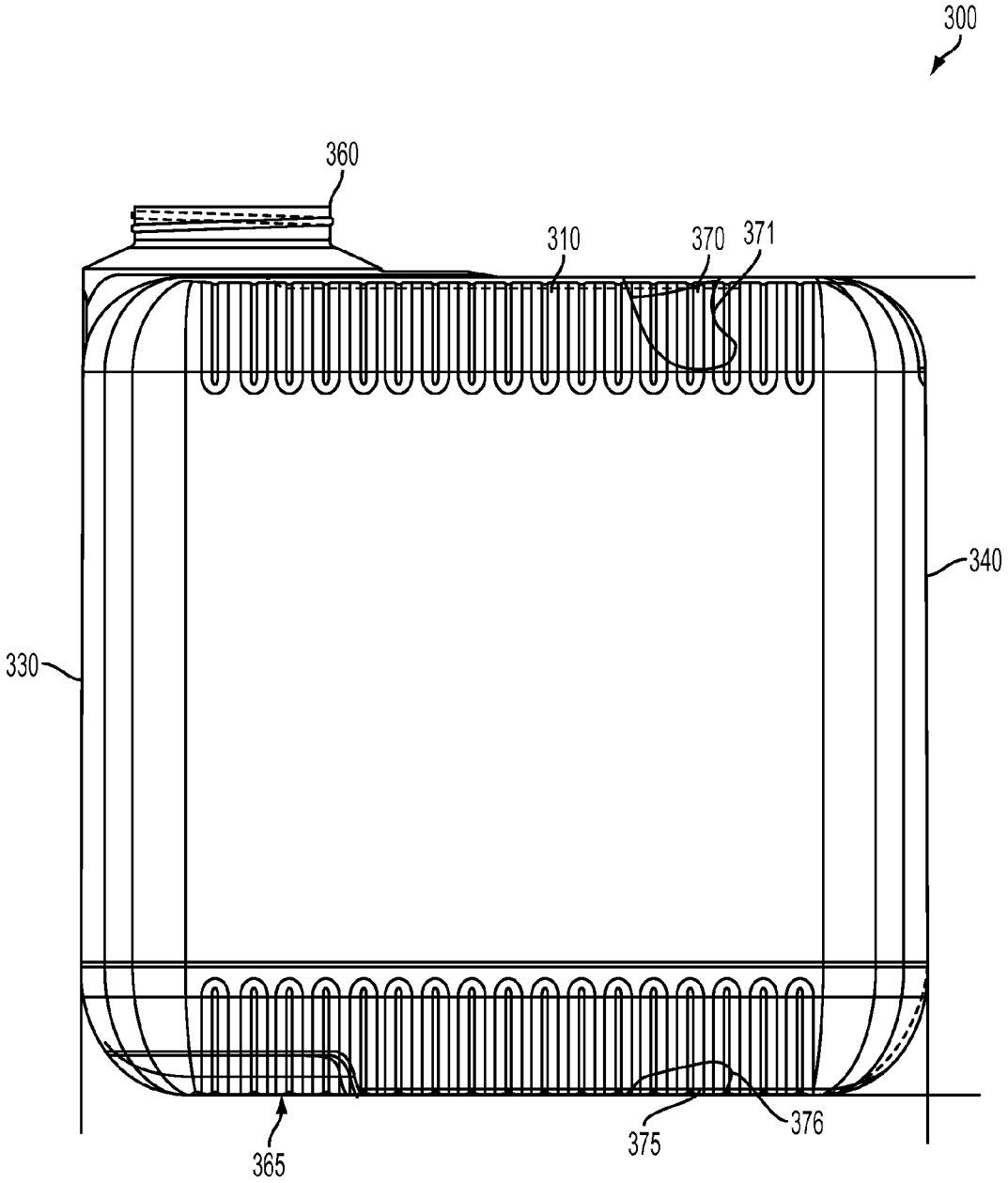
FIG. 19 is a side view of the plastic container in accord with the third embodiment.
Figure 20:
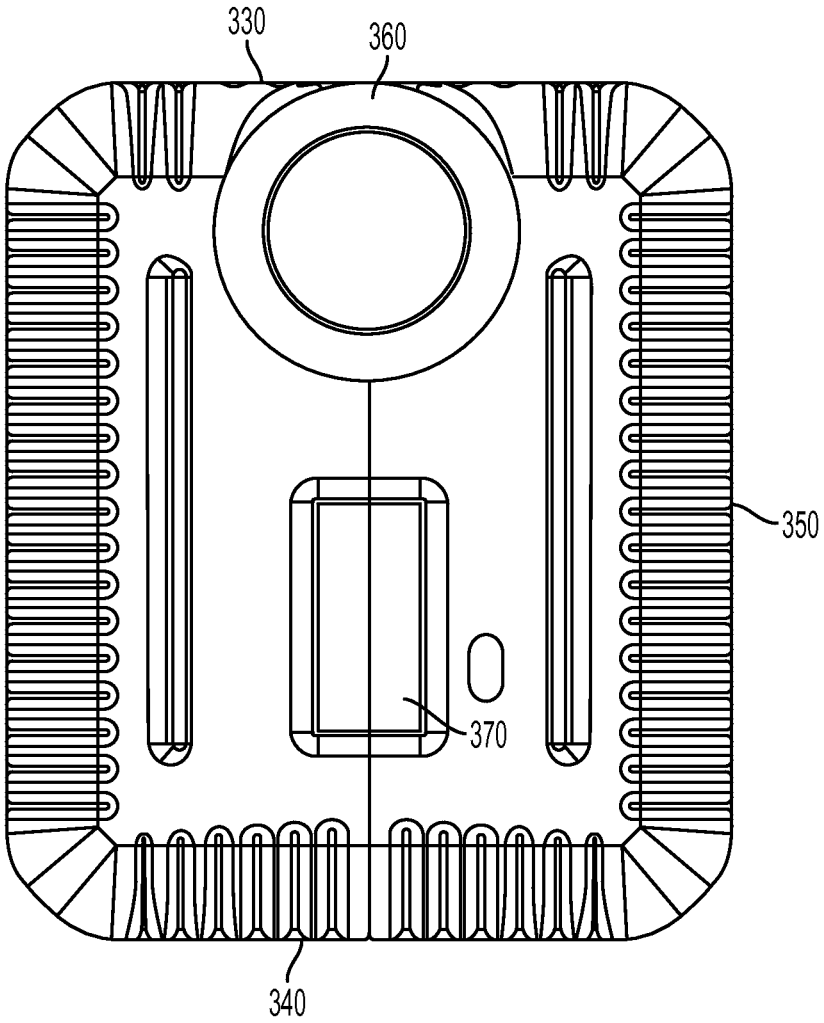
FIG. 20 is a top view of the plastic container of the third embodiment.

Although the handle 270 is formed to have a low profile so as to lay flat when folded, as shown in FIG. 17, the plastic container 200 may be formed with a parking recess 211 to limit the amount the handles 270 protrudes above the top 210 when folded.

The top 210 of the plastic container 100 also includes a two grip recesses 215 that enable a user to better grip the plastic container 200 when emptying contents from the container.

In contrast to the first embodiment, the neck 260 finish extends about the top 210 of the container. Consequently, when the plastic container 200 is placed within a corrugated carton 295, the neck 260 extends above the top of the carton. To accommodate this neck extension, the bottom of the plastic container 200 has a neck recess 265 sized to receive the neck 260 from an adjoining plastic container when stacked.

Figure 14:
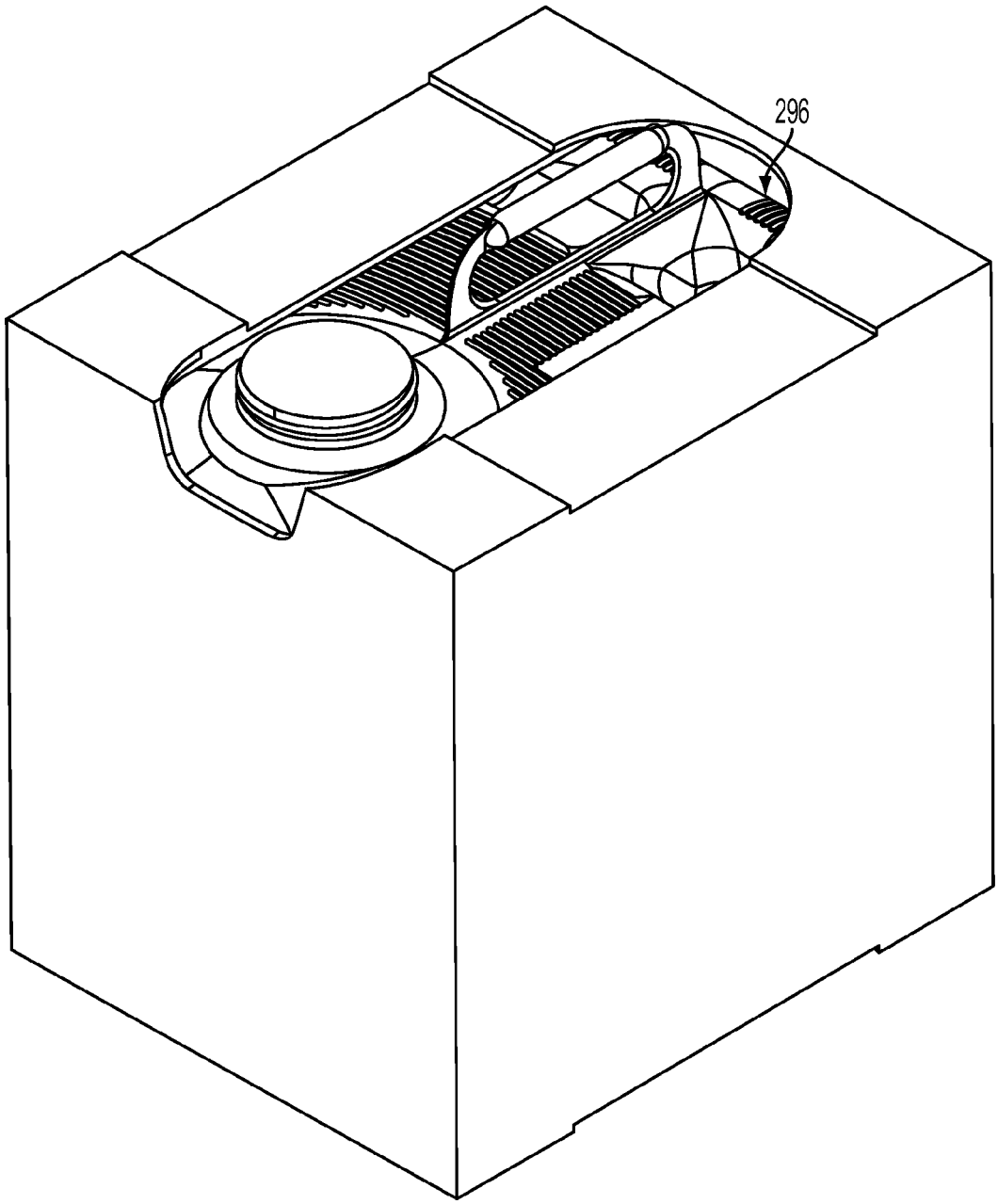
FIG. 14 is a top perspective view of the plastic container of FIG. 9 contained within a corrugated container in accord with the second embodiment.
Figure 15:
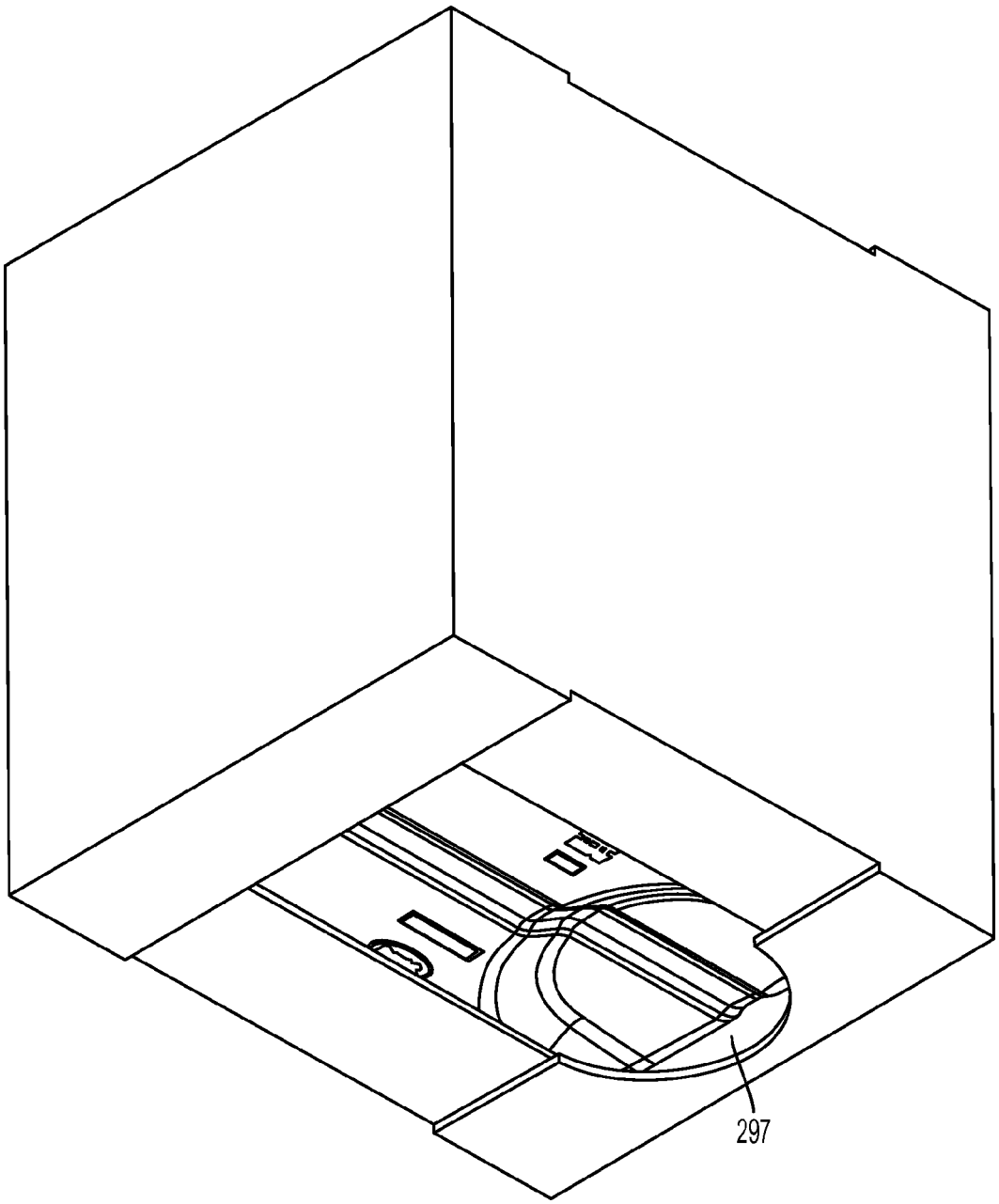
FIG. 15 is a bottom perspective view of the plastic container of FIG. 9 contained within a corrugated container in accord with the second embodiment.

Because of the lightweight nature of this plastic bottle 200, it is coupled with a corrugated carton as shown in FIGS. 14 and 15 to provide additional structural support. When used in this configuration, the packaging system (bottle and carton) is stackable. Otherwise, the plastic container 100 of this size when filled with oil, for example, may collapse on itself.

In addition, the corrugated carton 295 is fitted with a top opening 296 that permits access to the neck 260 and handle 270 for pouring. As shown in FIG. 14, the top opening 296 extends below the top of the plastic container 200 to a position behind the handle 270. This enables a user to empty the contents of the plastic container 200 without first removing it from the corrugated carton. The user can access the handle to rotate it upward. In addition, the extension of the opening along the front adjacent the neck, enables a user to pour contents without impacting the front of the corrugated carton 295. Accordingly, even after the packaging has been accessed to consume the contents, the packaging system remains intact. Thus, the stackability of the packaging system can be maintained until all of the product is consumed. In view of this, the corrugated carton also serves to absorb any liquid spillage that may ordinarily remain on the plastic container 100 after pouring out a portion of the contents.

In addition, as shown in FIG. 15, the bottom of the corrugated carton 295 also has an opening 297. This bottom opening is defined by the bottom flaps of the carton and may be gripped by a user when pouring the contents of the plastic container 100. This opening 297 includes a front portion that enables the neck 260 of a lower plastic container to enter the neck recess 265 when multiple containers are stacked vertically.

As shown in these figures, by providing the container with a foldable handle, the packing efficiency of the packaging system, i.e., the ratio of the internal volume of the corrugated carton to the internal volume of the plastic container 200 is greatly increased over the related art.

FIGS. 18-23 show features of the plastic bottle/corrugated carton container in accord with a third embodiment of the present invention. FIGS. 18-21 show multiple views of a plastic container 300 having a top 310, a bottom 320, a front 330, a back 340 and two sides 350. The plastic container 300 is sealable by placing a closure on a threaded portion of the neck (spout) 360. The plastic container may be made of various materials. However, in the present embodiment, to minimize weight, the bottle is made of high density polyethylene (HPDE) having a thickness of 0.010-0.014 inches. The volume of the plastic container 300 of this embodiment is about 584 ounces.

Additionally, to add some strength and rigidity to the plastic container 300, ribs 190 are added to various portions where needed. In this embodiment, the ribs 190 are added to the corners bridging the top 310 to the side portions and the corners bridging the bottom 320 to the side portions. A cross-sectional structure of these ribs is shown in FIG. 31. The ribs extend internally and have a radius of 0.03 inches, but this radius may range from 0.020 to 0.040 inches. Each rib is spaced 0.15 inches from an adjacent rib, but this spacing may range from 0.130 to 0.170 inches. The ribs are dimensioned add strength while not overly thinning the wall structure when the plastic container is molded.

The ribs 190 may be added to the front 330 of the plastic container 300 to provide additional strength to those portions below the neck 360 to prevent the neck 360 from sagging. Also, portions of the back 340 and sides 350 may also be fitted with ribs 190.

Ergonomically, the plastic container includes a top grip recess 370 that is placed in the center portion of the top 310 of the plastic container 300. This top grip recess 370 includes a protruding portion 371 that facilitates gripping by a user while preventing the user's grip from slipping while pouring contents from the plastic container 300. This top grip recess 370 is placed on the back half of the top 310 of the plastic container 300.

Figure 21:
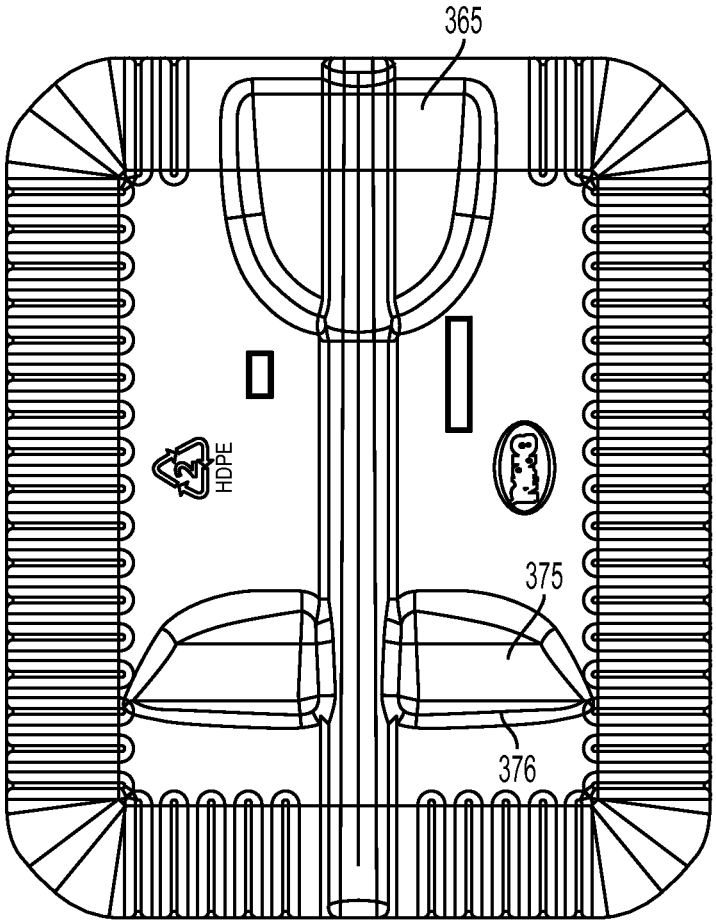
FIG. 21 is a bottom view of the plastic container of the third embodiment.

To maximize the internal volume of the plastic container 300, the width of this to grip recess 370 is limited to 4 inches in width. However, the width may be as small as 2.5 inches and as large as 4.5 inches. Otherwise, to maximize the volumetric efficiency, the top 310 surface of the plastic container is substantially planar, i.e., it may include some ribs to increase structural rigidity. In addition, to facilitate pouring of the contents, a bottom grip recess 375 may be added to the bottom of the container. This bottom grip recess 375 includes a gripping surface 376 that is extends within 10 degrees of a vertical direction to permit effective gripping when the plastic container is being tilted to pour contents. As shown in FIG. 21, two bottom grip recesses 375 may be included.

In contrast to the first embodiment, the neck 360 finish extends above the top 310 of the container. Consequently, when the plastic container 300 is placed within a corrugated carton 395, the neck 360 extends above the top of the carton. To accommodate this neck extension, the bottom of the plastic container 300 has a neck recess 365 sized to receive the neck 360 from an adjoining plastic container when stacked.

Figure 22:
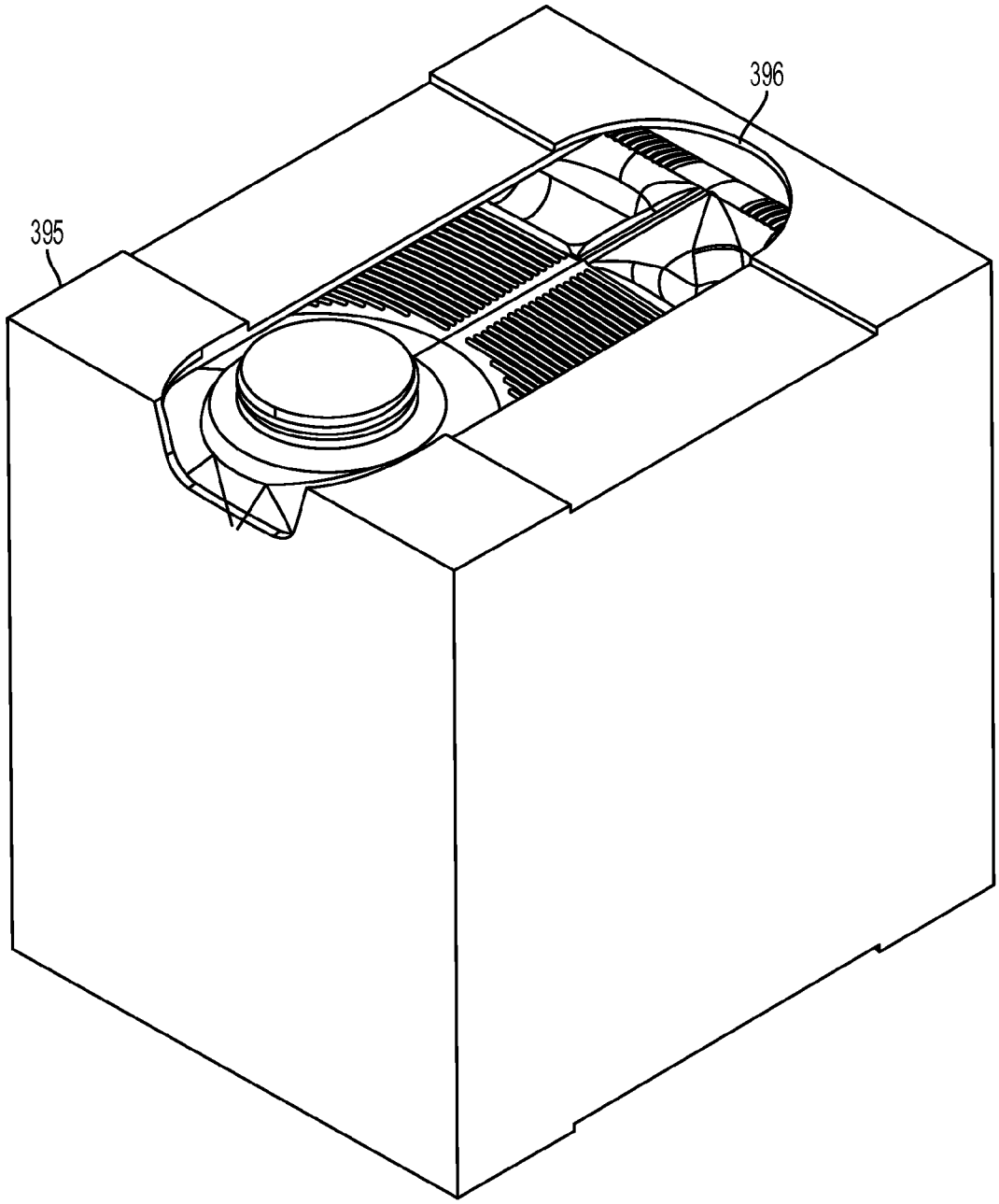
FIG. 22 is a top perspective view of the plastic container of FIG. 18 contained within a corrugated container in accord with the third embodiment.
Figure 23:
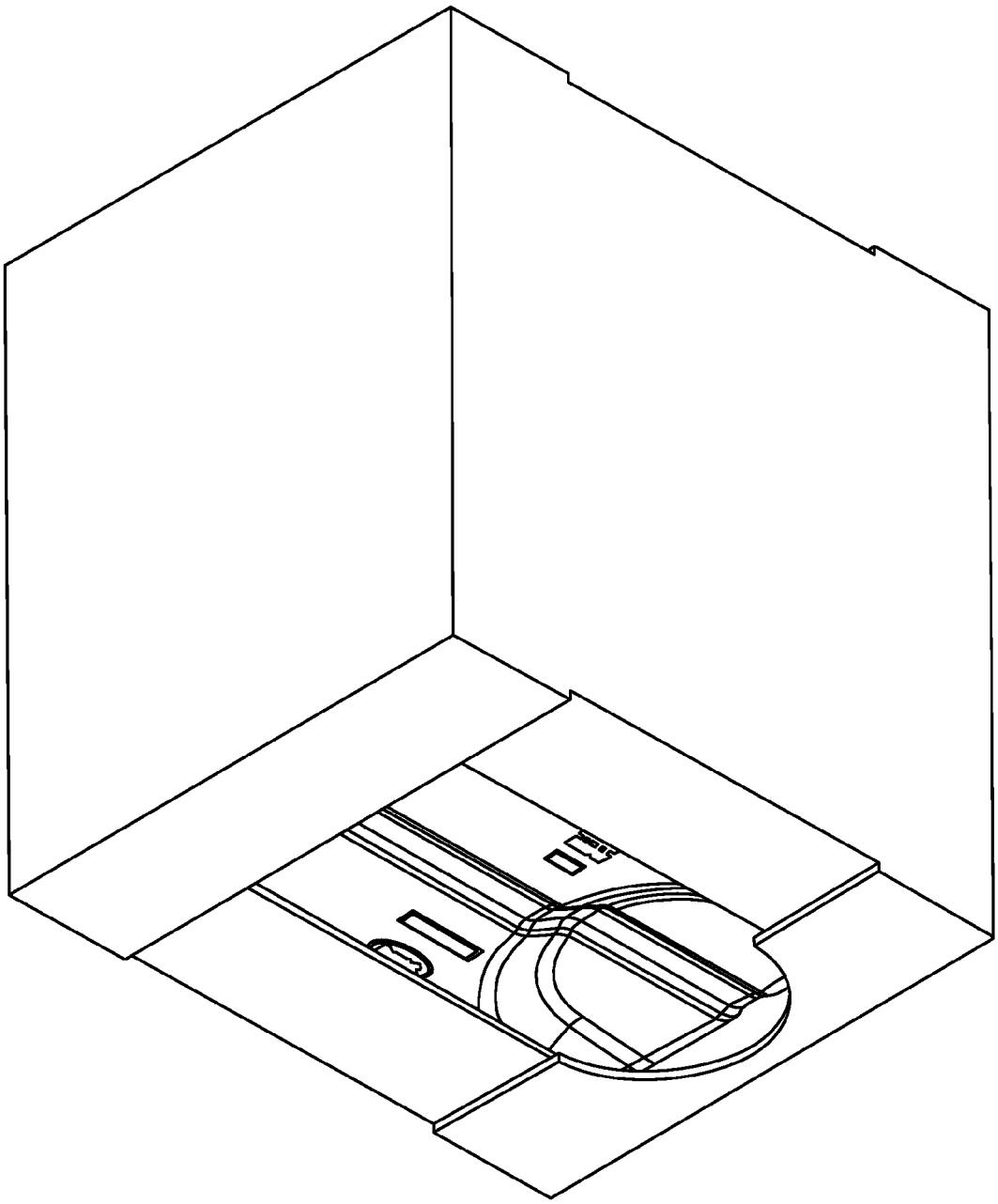
FIG. 23 is a bottom perspective view of the plastic container of FIG. 9 contained within a corrugated container in accord with the third embodiment.
Figure 24:
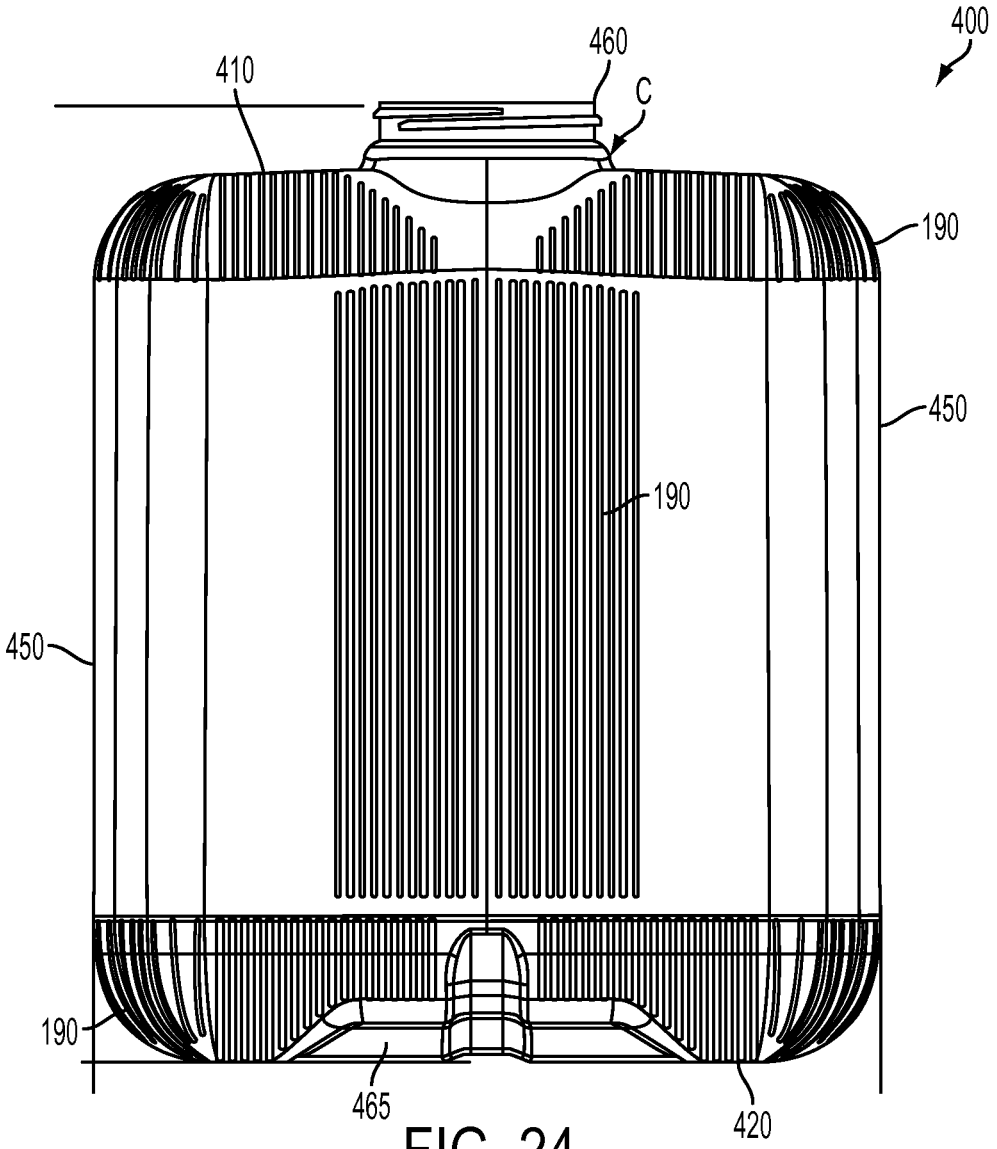
Figure 25:
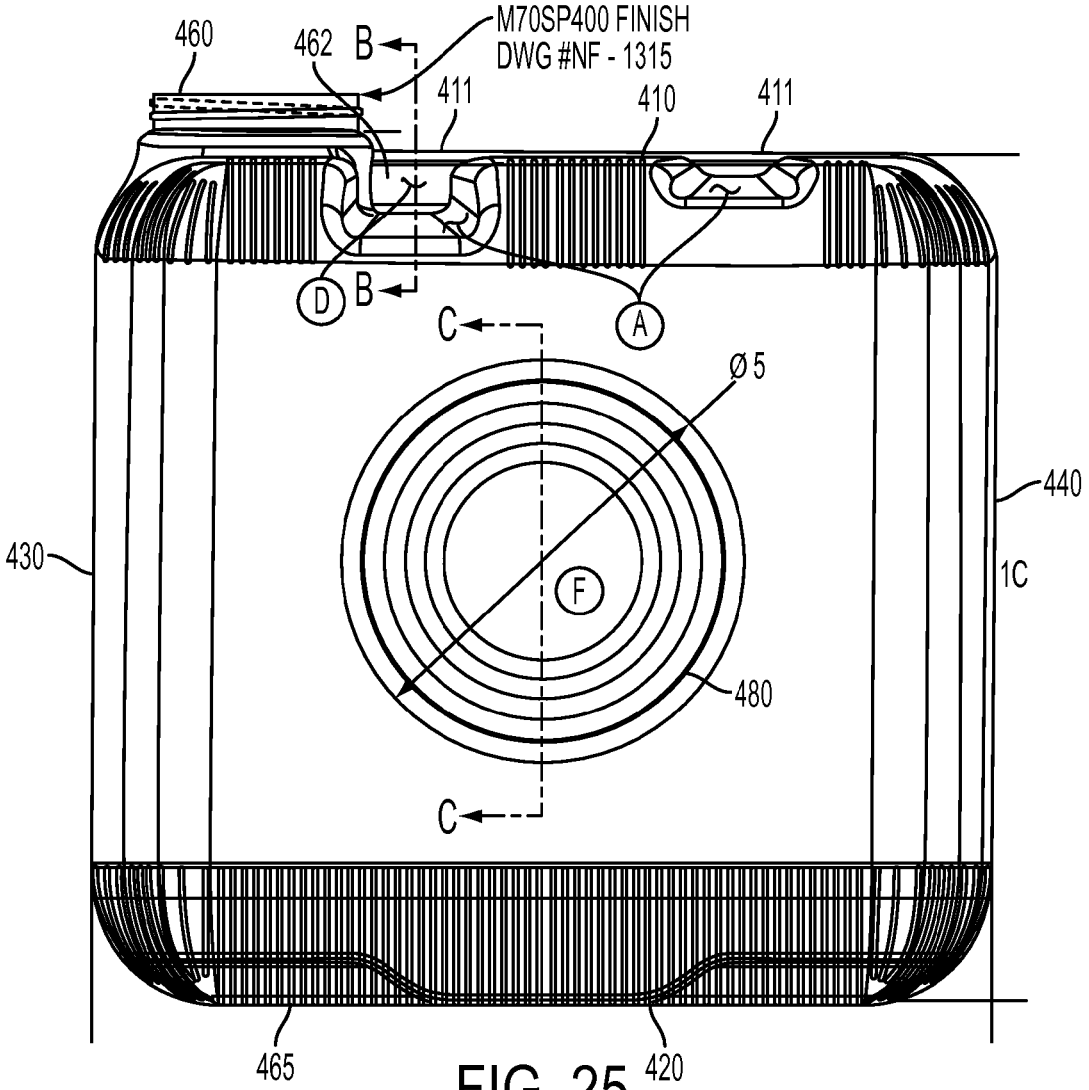
FIG. 25 is a side view of the plastic container in accord with the fourth embodiment.
Figure 26:
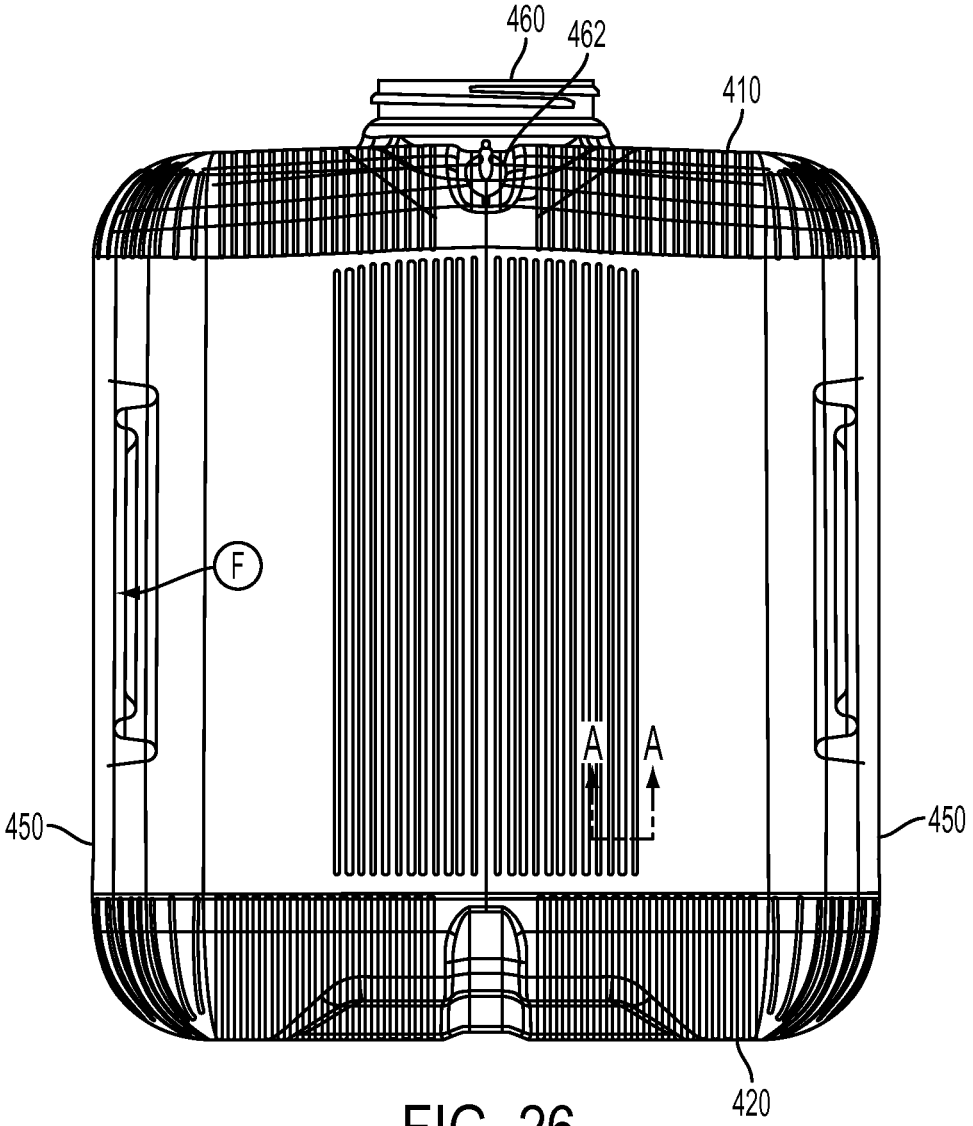
FIG. 26 is a rear view of the plastic container of the fourth embodiment.
Figure 27:
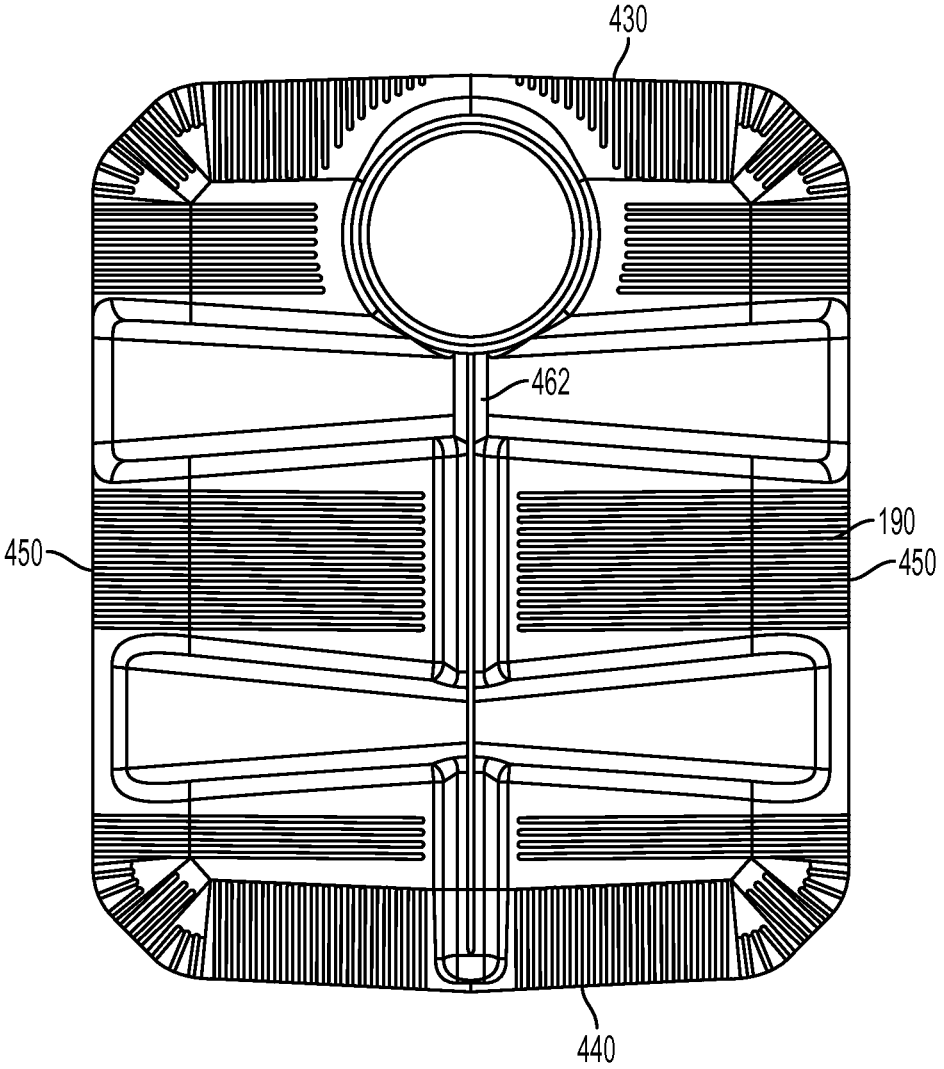
FIG. 27 is a top view of the plastic container of the fourth embodiment.
Figure 28:
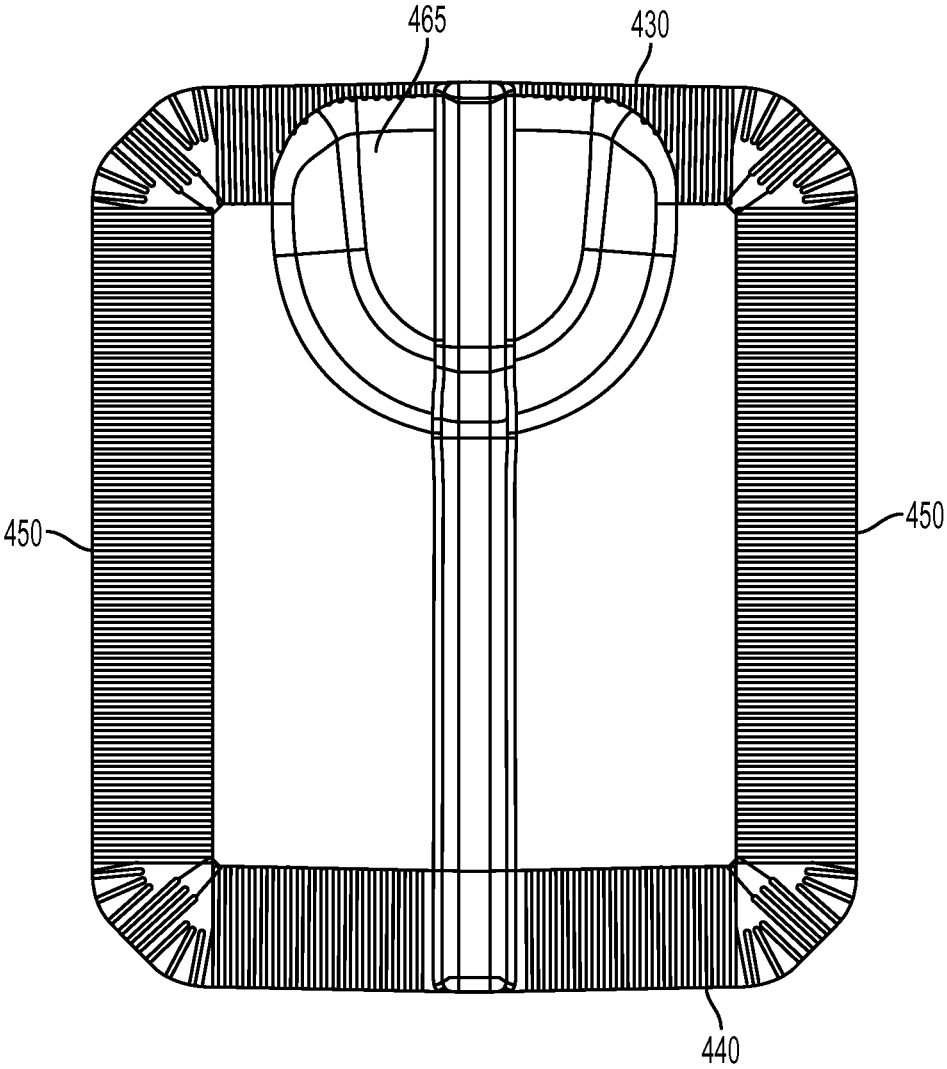
FIG. 28 is a bottom view of the plastic container of the fourth embodiment.

Because of the lightweight nature of this plastic container 300, it is coupled with a corrugated carton 395 as shown in FIGS. 22 and 23 to provide additional structural support. When used in this configuration, the packaging system (bottle and carton) is stackable. Otherwise, the plastic container 300 of this size when filled with oil, for example, may collapse on itself.

Using a corrugated carton 395 to house the plastic container 300 creates a packaging system that permits the use of a thin walled container 300. In addition, the corrugated carton 395 is fitted with a top opening 396 that permits access to the neck 360 and top grip recess 370 for pouring. As shown in FIG. 22, the top opening 396 extends below the top 310 on the front 130 of the plastic container to a position behind the top grip recess 370. This enables a user to empty the contents of the plastic container 300 without first removing it from the corrugated carton. In addition, the extension of the opening along the front adjacent the neck, enables a user to pour contents without impacting the front of the corrugated carton 395. Accordingly, even after the packaging has been accessed to consume the contents, the packaging system remains intact. Thus, the stackability of the packaging system can be maintained until all of the product is consumed. In view of this, the corrugated carton also serves to absorb any liquid spillage that may ordinarily remain on the plastic container 300 after pouring out a portion of the contents.

In addition, as shown in FIG. 23, the bottom of the corrugated carton 395 also has an opening 397. This bottom opening is defined by the bottom flaps of the carton and may be gripped by a user when pouring the contents of the plastic container 300. This opening also permits access to the bottom grip recesses 375.

As shown in these figures, by providing the container with recessed handles, the packing efficiency of the packaging system, i.e., the ratio of the internal volume of the corrugated carton to the internal volume of the plastic container 300, can be maximized.

FIGS. 24-33 show features of the plastic bottle/corrugated carton container in accord with a fourth embodiment of the present application. FIGS. 24-28 show multiple views of a plastic container 400 having a top 410, a bottom 420, a front 430, a back 440 and two sides 450. The plastic container 400 is sealable by placing a closure on a threaded portion of the neck (spout) 460. The plastic container may be made of various materials. However, in the present embodiment, to minimize weight, the bottle is made of high density polyethylene (HPDE) having a thickness of 0.010-0.014 inches. The volume of the plastic container 400 of this embodiment is about 584 ounces.

In contrast to the first embodiment, the neck 460 finish extends about the top 410 of the container. Consequently, when the plastic container 400 is placed within a corrugated carton 495, the neck 460 extends above the top of the carton. To accommodate this neck extension, the bottom of the plastic container 400 has a neck recess 465 sized to receive the neck 460 from an adjoining plastic container when stacked.

Additionally, to add some strength and rigidity to the plastic container 400, ribs 190 are added to various portions where needed. In this embodiment, the ribs 190 are added to the corners bridging the top 410 to the side portions and the corners bridging the bottom 420 to the side portions. A cross-sectional structure of these ribs is shown in FIG. 31. The ribs extend internally and have a radius of 0.03 inches, but this radius may range from 0.020 to 0.040 inches. Each rib is spaced 0.15 inches from an adjacent rib, but this spacing may range from 0.130 to 0.170 inches. The ribs are dimensioned add strength while not overly thinning the wall structure when the plastic container is molded.

The ribs 190 may be added to the front 430 of the plastic container 400 to provide additional strength to those portions below the neck 460 to prevent the neck 460 from sagging. Also, the portions of the back 440 and sides 450 may also be fitted with ribs 190.

Ergonomically, the plastic container includes two top recesses 411 on the top 410 of the plastic container 400. These recesses 411 form a ridge therebetween which adds to the rigidity of the top 410 of the plastic container 400.

While conventional plastic containers utilize a handle that is integrally molded with the plastic container, when the container walls are designed to have a finished thickness of 0.010-0.014 inches, such a complex shape may induce material thickness variations falling well below this thickness range, and thus, may result in weak or thin areas highly susceptible to failure. Consequently, in this embodiment, the rear recess 411 provides a surface that enables a user to pour the contents by tilting the plastic container 400 toward the neck 460.

Figure 30:
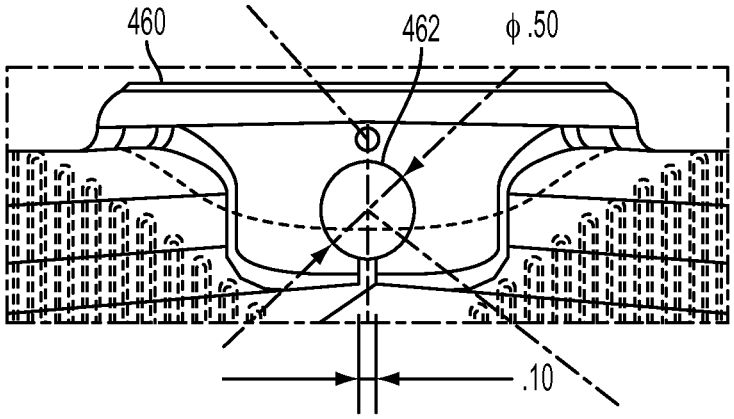
FIG. 30 is cross-sectional view of the anti-glug tube in accord with the fourth embodiment.

The forward recess 411 is adjacent the neck 460 and runs horizontally from side to side across the container. This forward recess 411 provides separation from the upper volume of the container and the neck 460. These portions are connected using a tube 462 that permits air flow into the top of the plastic container 400 during pouring to prevent glugging. FIG. 30 shows a cross-sectional view of the tube 462 extending from the neck 460 of the container.

Figure 29:
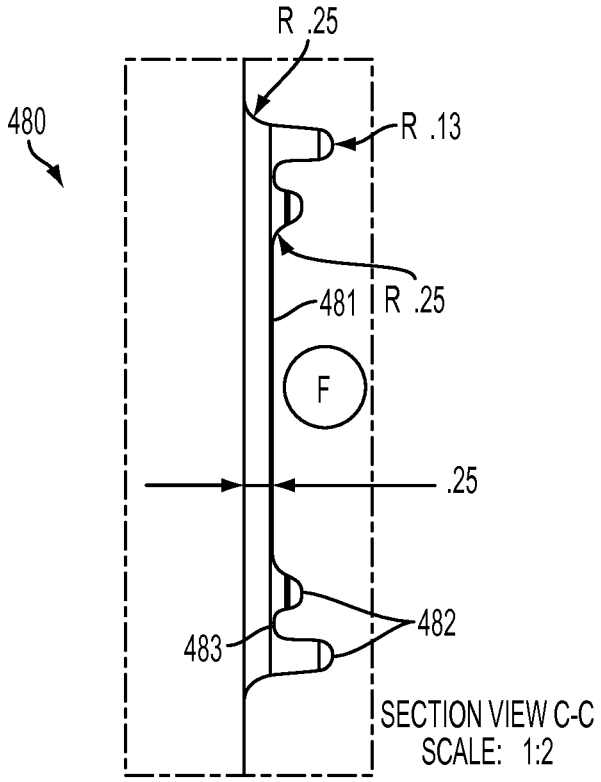
FIG. 29 is a cross-sectional view of the speaker in accord with the fourth embodiment.

This embodiment also includes a speaker unit 480 that is designed to absorb pressure generated in the event the plastic container 400 receives an impact, e.g., the container is dropped. A cross-section of the speaker unit 480 is shown in FIG. 29. The speaker unit 480 comprises a center portion 481 that is connected to the side 450 by at least one U-shaped portion 482 that runs concentrically around the center portion 481. In this embodiment two U-shaped portions 482 are joined by an inverted U-shaped portion 483 that projects outward. The radius of the U-shaped portion is in the range of 0.10 to 0.20 inches. Additionally, because this plastic container 400 is used in combination with a corrugated carton 495 as described below. The center portion 481 is disposed inside of the plane of the side 450 surface so that it has room to move outward when the packaging system is dropped. In this embodiment, the center portion 481 is offset from the side 450 by a distance of 0.25 inches. However, this distance may range from 0.15 to 0.035 inches.

Figure 32:
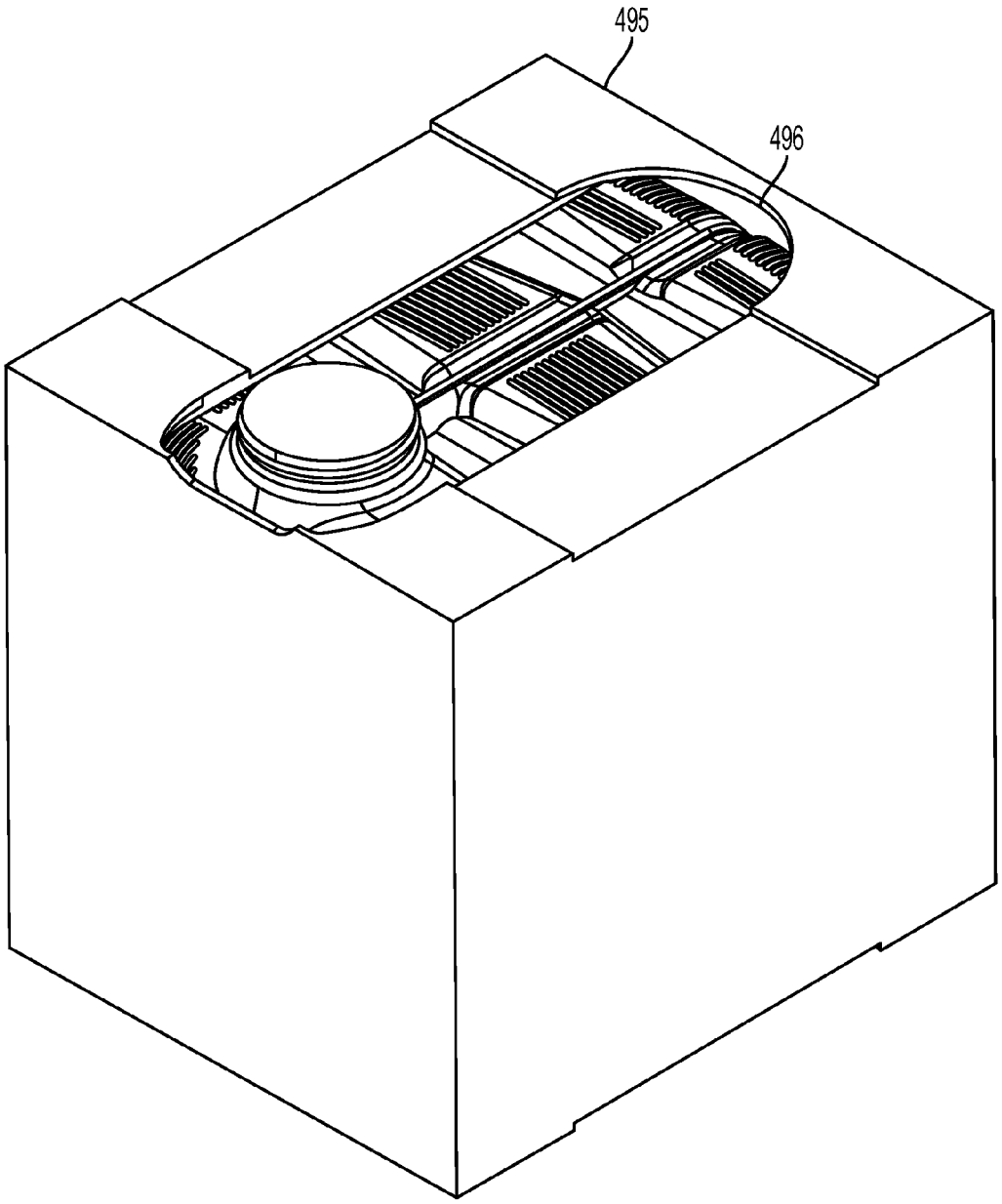
FIG. 32 is a top perspective view of the plastic container of FIG. 23 contained within a corrugated carton in accord with the fourth embodiment.
Figure 33:
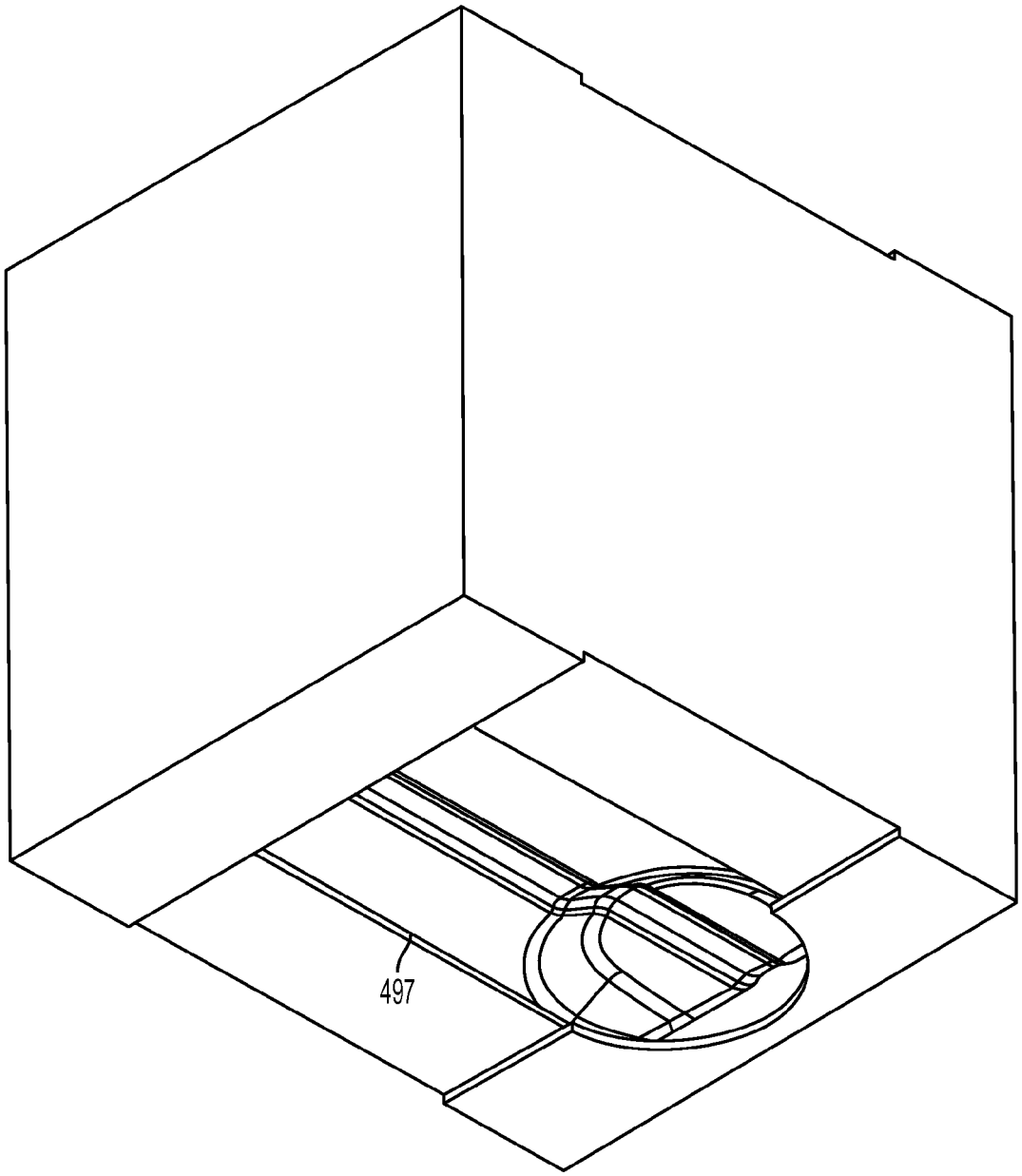
FIG. 33 is a bottom perspective view of the plastic container of FIG. 23 contained within a corrugated carton in accord with the fourth embodiment.

Because of the lightweight nature of this plastic container 400, it is coupled with a corrugated carton 495 as shown in FIGS. 32 and 33 to provide additional structural support. When used in this configuration, the packaging system (bottle and carton) is stackable. Otherwise, the plastic container 400 of this size when filled with oil, for example, may collapse on itself.

Using a corrugated carton 495 to house the plastic container 400 creates a packaging system that permits the use of a thin walled container 400. In addition, the corrugated carton 495 is fitted with a top opening 496 that permits access to the neck 460 and rear recess 411 for pouring. As shown in FIG. 32, the top opening 496 extends through at least the height of the neck 460 to a position behind the rear recess 411. This enables a user to empty the contents of the plastic container 400 without first removing it from the corrugated carton. The user can access the handle to rotate it upward. In addition, as shown in FIG. 33, the bottom of the corrugated carton 495 also has an opening 497. This bottom opening is defined by the bottom flaps of the carton which may be gripped by a user when pouring the contents of the plastic container 400.

This opening 47 includes a front portion that enables the neck 460 of a lower plastic container to enter the neck recess 465 when multiple containers are stacked vertically.

Accordingly, even after the packaging has been accessed to consume the contents, the packaging system remains intact. Thus, the stackability of the packaging system can be maintained until all of the product is consumed. In view of this, the corrugated carton also serves to absorb any liquid spillage that may ordinarily remain on the plastic container 100 after pouring out a portion of the contents.

Tables 1 and 2 show the volumetric packing efficiencies of a comparative packing system in contrast to the improved volumetric packing efficiencies of the embodiments of the present invention. It is noted that both bottles are sized to carry 584 ounces.

TABLE 1

Volumetric Efficiencies of a Comparative Example
GMA (Notched) 48.0 × 40.0 × 5.0

| | Bottle (ID) | Bottle (OD) | Carton Bulge | Carton (ID) | Carton (OD) | Packer Bulge | UnitLoad (Incl. Pal) |
|---|---|---|---|---|---|---|---|
| Ln: | 9.44 in | 9.44 in | 0.00 in | 9.09 in | 9.40 in | 0.00 in | 47.0 in |
| Wd: | 9.09 in | 9.09 in | 0.00 in | 9.44 in | 9.75 in | 0.00 in | 39.0 in |
| Ht: | 15.20 in | 15.20 in | 0.00 in | 15.20 in | 15.82 in | 0.00 in | 52.5 in |
| Grs: | | 584.00 oz | | | 37.18 lb | | 2295.8 lb |
| Cube: | 1185.60 in3 | 1185.60 in3 | | 1303.96 in3 | 1450.75 in3 | | 55.7 ft3 |
| | | Height Vert | | | Height Vert | | |
| Bottle: | | | | | 1 | | 60 |
| Carton: | | | | | | | 60 |
| Cases per layer: | | | | | | | 20 |
| Layers/load: | | | | | | | 3 |
| Pattern: | | | | | 1 × 1 × 1 | | Column |

Figure 34:
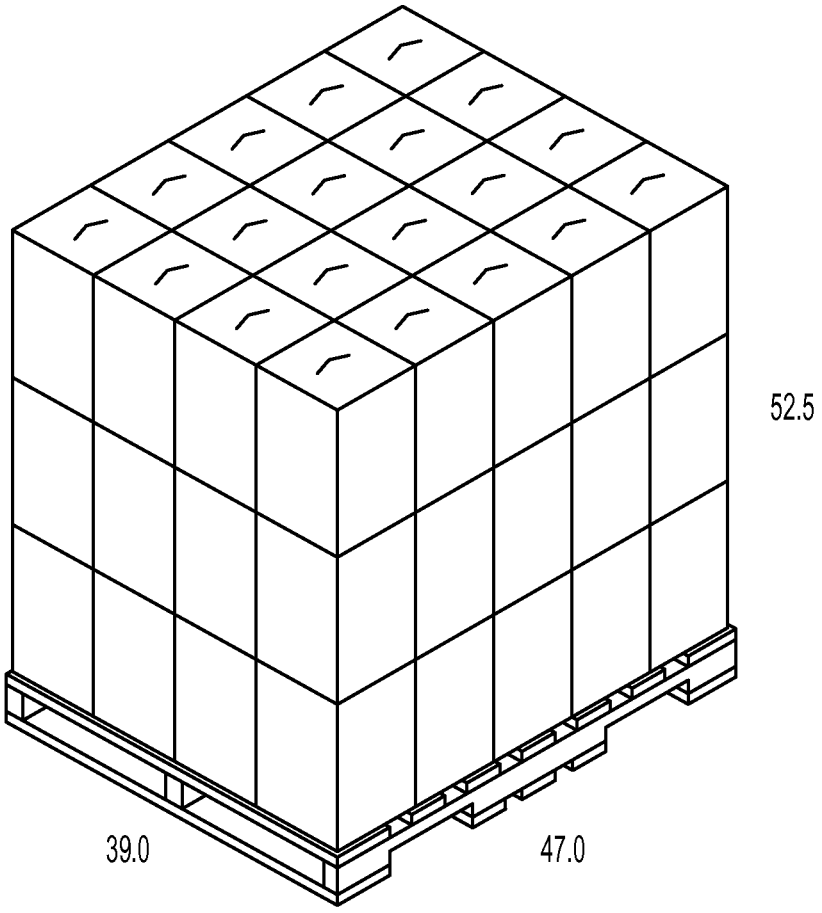
FIG. 34 is a perspective view of a pallet packed with a packaging system in the related art.

Table 1 represents the bottle and carton sized representative of a 351b bottle as disclosed in U.S. Patent publication 2008/0073317. In view of the configuration of this bottle design, as shown in FIG. 34, only 60 packages can be placed on a typical pallet.

TABLE 2

Volumetric Efficiencies of Embodiments 1-4
GMA (Notched) 48.0 × 40.0 × 5.0

| | Bottle (ID) | Bottle (OD) | Carton Bulge | Carton (ID) | Carton (OD) | Packer Bulge | UnitLoad (Incl. Pal) |
|---|---|---|---|---|---|---|---|
| Ln: | 11.44 in | 11.44 in | 0.00 in | 9.44 in | 9.75 in | 0.00 in | 47.0 in |
| Wd: | 9.44 in | 9.44 in | 0.00 in | 11.44 in | 11.75 in | 0.00 in | 39.0 in |
| Ht: | 11.05 in | 11.05 in | 0.00 in | 11.05 in | 11.68 in | 0.00 in | 51.7 in |
| Grs: | | 584.00 oz | | | 37.20 lb | | 2445.8 lb |
| Cube: | 1042.16 in3 | 1042.16 in3 | | 1193.33 in3 | 1338.14 in3 | | 54.9 ft3 |
| | | Height Vert | | | Height Vert | | |
| Bottle: | | | | | 1 | | 64 |
| Carton: | | | | | | | 64 |
| Cases per layer: | | | | | | | 16 |
| Layers/load: | | | | | | | 4 |
| Pattern: | | | | | 1 × 1 × 1 | | Column |

Figure 35:
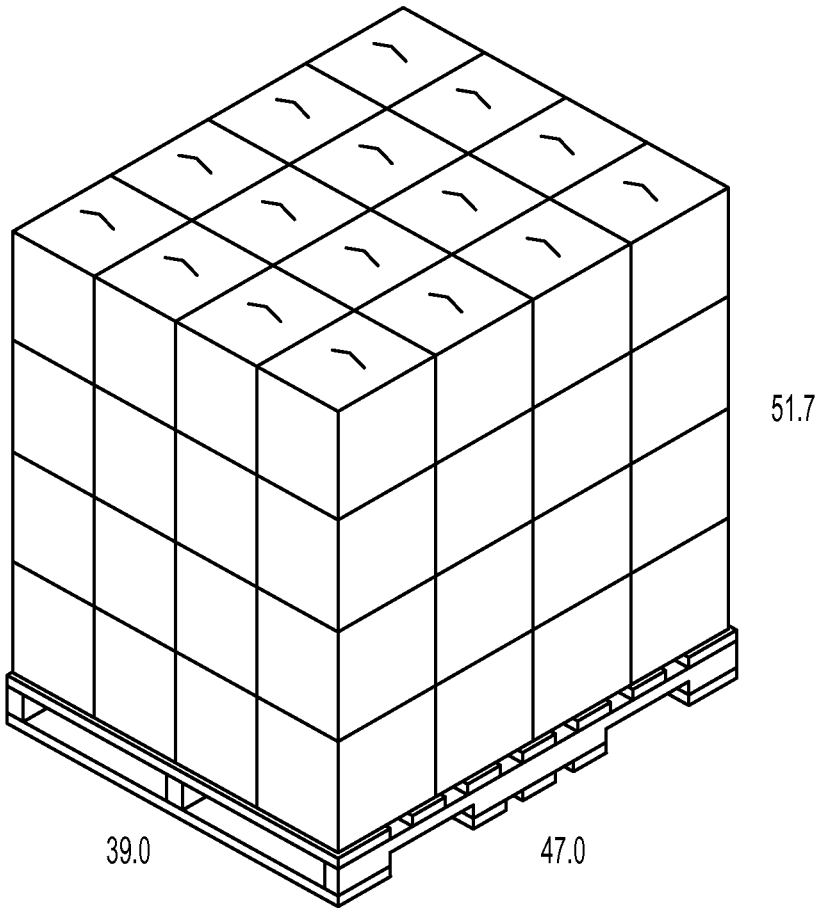
FIG. 35 is a perspective view of a pallet packed with a packaging system in accord with the exemplary embodiments of the invention.

As shown above, the embodiments of the present invention utilize the overall packing space more efficiently. Accordingly, as shown in FIG. 35, 64 packages can be fitted on a typical pallet to provide a 6.67% increase over the related art.

Regarding packing efficiencies, the bottles each are designed to contain 584 ounces. However, the comparative example requires a carton having an interval volume of 1303.96 cubic inches, or 722 ounces. This provides a packing efficiency of 584 divided by 722, or about an 80% packing efficiency. By contrast, the various embodiments require a carton having an internal volume of 1193.3 cubic inches, or 661 ounces. This provides a packing efficiency of 584 divided by 661, or about an 88% packing efficiency.

While this invention has been particularly shown and described with reference to exemplary embodiments thereof, the above description should be considered in as illustrations of the exemplary embodiments only and are not for purposes of limitation. Therefore, the scope of the invention is defined not by the detailed description of the invention but by the appended claims, and all differences within the scope will be construed as being included in the present invention. Additionally, the features described in the various embodiments are not exclusive in that a feature of one embodiment may be incorporated into another embodiment.

What is claimed is:

1. A packaging comprising:

a container in a box;

the container having an inner surface defining a cavity, the container comprising:

a top;

a bottom;

sides extending from the top to the bottom and comprising a front side and a back side;

a neck extending from the top of the container, the neck defining a passageway for inserting and removing contents from the cavity;

a handle pivotally attached to a flash portion of the container;

a recess portion configured to receive the handle when the handle is in a first position such that the handle does not protrude above the top of the container; and a tube extending from the neck to the flash portion, the tube defining a channel that is in communication with the passageway; and the box comprising:

a top cover, a bottom cover and side portions extending from the top cover to the bottom cover that include a front side and a back side;

an opening on the top cover that exposes the neck for pouring the contents of the cavity and that provides space for folding the handle between the first position where the handle contacts the top of the container and a second position where the handle extends upward from the top of the container; and an opening in the bottom cover that exposes the bottom of the container.

2. The packaging according to claim 1, wherein a top of the neck is disposed below a level of the top cover.

3. The packaging according to claim 1, wherein a top of the neck extends above a top level of the top cover.

4. The packaging system according to claim 3, further comprising a grip recess portion on the top of the bottle disposed at a rear portion of the top.

5. The packaging according to claim 3, wherein the bottom of the container includes a recess directly below the neck that is sized to fit and receive a neck of the same size.

6. The packaging according to claim 5, wherein the opening in the bottom cover is sized to expose the recess to enable insertion of a neck of an adjacent container.

7. The packaging according to claim 1, wherein the average wall thickness of the sides is within the range 0.010 to 0.014 inches.

8. The packaging system according to claim 1, further comprising a second recess portion positioned adjacent the neck, wherein the tube extends from a side of the neck over the second recess portion.

9. The packaging system according claim 1, further comprising protrusions disposed on the recess portion configured to secure the handle before it is pivotally attached to the container.

10. The packaging system according to claim 1, wherein the channel is in communication with the cavity.

11. The packaging system according to claim 1, wherein the tube permits air flow into at least one of the passageway and the cavity during pouring to prevent glugging.

12. The packaging system according to claim 1, wherein the tube is spaced apart from the handle.

13. A packaging comprising:

a container in a box, the container comprising:

a top, a bottom, sides extending from the top to the bottom, a neck extending from the top of the container for inserting and removing contents from the container, and a solid handle attached to a flash portion of the container; and the box comprising:

a top cover, a bottom cover and side portions extending from the top cover to the bottom cover that include a front side and a back side, a top of the neck extending above a top level of the top cover, an opening on the top cover that exposes the neck for pouring the contents of the container, and an opening in the bottom cover that exposes the bottom of the container.

14. The packaging system according to claim 13, wherein the handle is integrally formed using flash generated when molding the container.

15. The packaging system according to claim 13, wherein the bottom of the container includes a recess directly below the neck that is sized to fit and receive a neck of the same size.

16. The packaging system according to claim 13, wherein:

top of the neck extends above a top level of the top cover;

the bottom of the container includes a recess directly below the neck that is sized to fit and receive a neck of the same size; and the opening in the bottom cover is sized to expose the recess to enable insertion of a neck of an adjacent container.

17. The packaging system according to claim 13, further comprising a speaker unit disposed on at least one of the sides of the container to absorb pressure to thereby prevent a failure of the container.

18. A container comprising:

a neck extending from a top of the container, the neck defining a passageway for inserting and removing contents into an inner cavity of the container;

a handle pivotally attached to a flash portion of the container;

a first recess configured to receive the handle when the handle is in a first position such that the handle does not protrude above the top of the container;

a second recess; and a tube extending from a side of the neck over the second recess, the tube defining a channel that is in communication with the passageway.

19. The container according to claim 18, wherein tube is spaced apart from the handle.

* * * * *